US005820643A

United States Patent [19]

Lienenlüke et al.

[11] Patent Number: 5,820,643

[45] Date of Patent: Oct. 13, 1998

[54] DUST FILTER BAG FOR A VACUUM CLEANER

[76] Inventors: Paul Lienenlüke, Elberfelder Str. 115, Sprockhövel, Germany, 45549; Stefan Kraut-Reinkober, Am alten Schafstall 1, Leverkusen, Germany, 51373

[21] Appl. No.: 737,378

[22] PCT Filed: Apr. 22, 1995

[86] PCT No.: PCT/EP95/01528

§ 371 Date: Jan. 21, 1997

§ 102(e) Date: Jan. 21, 1997

[87] PCT Pub. No.: WO95/29621

PCT Pub. Date: Nov. 9, 1995

[30] Foreign Application Priority Data

May 2, 1994 [DE] Germany ..... 44 15 350.3

[51] Int. Cl.[6] ..... B01D 46/02

[52] U.S. Cl. ..... 55/367; 55/376; 55/472

[58] Field of Search ..... 55/361, 367, 376, 55/377, 472

[56] References Cited

U.S. PATENT DOCUMENTS

| | | | |
|---|---|---|---|
| 2,070,674 | 2/1937 | Muentener . | |
| 2,758,667 | 8/1956 | Brace | 55/367 |
| 2,864,462 | 12/1958 | Brace | 55/367 |
| 3,432,998 | 3/1969 | Downey et al. | 55/377 |
| 3,483,679 | 12/1969 | Balbierer | 55/367 |
| 3,495,386 | 2/1970 | Bixler et al. | 55/367 |
| 3,724,179 | 4/1973 | Leinfelt . | |
| 5,039,324 | 8/1991 | Goldberg | 55/367 |
| 5,158,635 | 10/1992 | Schmierer et al. | 55/367 |
| 5,468,272 | 11/1995 | Schmierer | 55/367 |

FOREIGN PATENT DOCUMENTS

| | | | |
|---|---|---|---|
| 0202639 | 11/1986 | European Pat. Off. . | |
| 0623305 | 11/1994 | European Pat. Off. . | |
| 0627189 | 12/1994 | European Pat. Off. . | |
| 1628582 | 11/1971 | Germany . | |
| 8914469 | 4/1991 | Germany . | |
| 4011666 | 10/1991 | Germany . | |
| 4341248 | 6/1995 | Germany . | |
| 4413248 | 10/1995 | Germany . | |
| 27162 | 12/1908 | United Kingdom | 55/367 |

*Primary Examiner*—C. Scott Bushey
*Attorney, Agent, or Firm*—Martin A. Farber

[57] ABSTRACT

A dust filter bag (1) for a vacuum cleaner (3), with a retaining plate (H). The bag is constructed of a solid paper material, such as cardboard for example, to which a dust bag (12) is joined, for example adhesively, with a closure flap (13) turned towards the inside (15) of the dust bag (12), hinged on the retaining plate (H), which closure flap (13) is openable against a spring action and, in closed condition, keeps closed an opening (O) in the retaining plate (H). To make the dust filter bag simpler in construction and more advantageous as regards use, a band-like spring element (F) is attached to the closure flap (13) in such a way that, in the closed condition (FIG. 4), there is formed a clearance (Y) between a band end (E—E) and a hinge axis (14), lying outside of the band, of the closure flap (13), where the hinge axis (14) is provided turned towards the inside (15) of the dust bag (1).

28 Claims, 16 Drawing Sheets

34
36
35
31
51
II
III
IV
1
Ö
24
32
33
50
XXX
XXXI
XXIX

DUST FILTER BAG FOR A VACUUM CLEANER

FIELD AND BACKGROUND OF THE INVENTION

The invention relates to a dust filter bag for a vacuum cleaner, with a retaining plate comprising a solid paper material, such as cardboard for example, to which a dust bag is joined, for example adhesively, with a closure flap turned towards the inside of the dust bag, hinged on the retaining plate, which closure flap is openable against a spring action and, in closed condition, keeps closed an opening in the retaining plate.

A dust filter bag of this type is known through U.S. Pat. No. 2,070,674. The closure flap turned towards the inside of the dust bag, hinged on the retaining plate and keeping the opening closed, hangs on a hinge flap joined to the retaining plate. A sooket provided with hat brim is inserted through the opening. The socket projects in the direction of the blower pipe of the vacuum cleaner and tapers funnel-shaped in that direction. A blower connection piece penetrates self-supportingly into this funnel opening. The hat brim serves, with its surface on the retaining-plate side, to support the socket on the edge of the opening, while the surface turned towards the inside of the dust bag functions as a bearing surface or valve seat surface of the closure flap. The self-closing action of the closure flap is based on the restoring force of an elastic thread freely bridging over the back of the closure flap. The two ends of the elastic thread are clamped in peripheral clamping slots of the base plate. The securing in position of the elastic thread on the closure-flap side is effected by a relief-cut, bent-out retaining tongue. Since the corresponding bending-out leaves behind a consequential relief-cut hole, this dust filter bag is not entirely impervious. When the filled dust bag is taken hold of, air and dust emerge through this hole. This solution is also quite complicated.

A self-closing arrangement for dust filter bags is also known from DE-OS 16 28 582. There, dispensing with special hinge flaps, a diametrically divided closure flap, that is one having two halves (see FIGS. 17 to 19 of this earlier arrangement) is hinged to the base plate, by rabetted lines. The spring action in the closed position is obtained here from two leaf springs aligned transverse to the aforesaid diametrical division, which leaf springs are mounted between the double-layers of the retaining plate and bias the halves. The opening of the closure flap occurs by means of the penetration of the opening in the retaining plate by the blower connecting piece of the vacuum cleaner.

Through DE-OS 40 11 666 it is finally known positively to control the closure flap, again hinged by means of a hinge flap in respect of its closure, of a dust filter bag. In the closed position, however, the closure flap loses its valve function, because it is held pivoted away from the region of the opening, outside of the retaining plate, that is, on the side turned away from the inside of the dust bag. The closure flap, which is guided back in the direction in the opening of the retaining plate upon lateral pulling-away of the retaining plate, is finally pressed into the suitably large opening. It is therefore necessary to arrange an adhesive strip as closure securing means.

SUMMARY OF THE INVENTION

It is an object of the invention to provide a dust filter bag of this type which is simpler in construction and more advantageous as regards use.

As a result of such the arrangement of the invention, dust filter bag improved with regard to construction and use is realised. The above described closure aids in the form of a special elastic spring or the use of leaf springs as spring elements are just as dispensable as is a hinge construction peculiar to the retaining plate. High-quality cardboard may therefore be dispensed with. Also the sealing effect is not impaired; the relief cut is omitted. For this purpose the procedure is that a band-like spring element is arranged on the closure flap in such a way that, in the closed position, a clearance is formed between a band plane and a hinge axis, lying outside of the band, of the closure flap, and the hinge axis is arranged turned towards the inside of the dust bag. The spring element simultaneously forms the hinge axis. Lateral offsetting of spring element and hinge axis allows development of tensile stress. An energy store is loaded. The spring element provides a restoring effect so high that the so-called Self-Closing-Effect is assured in the simplest manner. On the other hand, however, there remains a high readiness to fold, so that the blowing flow is not blocked in such a way as to hinder operation. The aforesaid clearance, resulting from the plate thickness of the retaining plate, is moreover entirely sufficient. The spring element is easily attached to an outwardly-turned first surface of the closure flap. If required, the entire surface may be used here. That may even go so far that the spring element continues into an edge seal of the closure flap, by which there is attributed a further function to this spring element. The spring element would in this case then advantageously comprise a rubber-layer blank. In keeping with this idea, a further advantageous possible solution consists in the spring element being formed as a layer element substantially fully overlapping the first surface, which means that the inner field of the closure flap may even be taken out. The closure flap would then comprise a closure-flap frame covered like a drumskin. This frame may be annular in shape. The weight of the closure flap can thus be reduced. Further, the retaining plate is advantageously provided with a bearing surface adapted to the profile of the closure flap. Matching the profile in this way protects the hinge-axis on closure of the closure flap, precisely in the condition of increased mechanical stress, for example by the bearing pressure of the dust particles etc. collected in the dust bag. Moreover, there is produced a circumferential angle joint which especially effectively prevents the emergence of dust, compared with a closure flap which is simply surface-resting, and not profiled. Moreover, the invention provides the proposal that the spring element is an elastic, for example rubber-elastic, band element and, in resiliently extended condition in the closed position of the closure flap, joins the latter to the retaining plate. The corresponding anchoring is possible by simple means, for example by adhering and or stitching. The effectively selectable preloading thus provided even makes the self-closing effect adjustable. Such a variation appears advantageous having regard to an individual adaptation to different types of vacuum cleaner. Further, it is favourable in this connection for the band element to have a preloading corresponding to approximately 10% of the elastic extension reserve, in a closed position of the closure flap. The preloading can take effect right at the beginning, that is during the sandwich-like mounting of the retaining plate, namely by pulling the captive-side end the appropriate distance and fixing of same. An arrangement which, in contrast, itself produces the preloading may be obtained by simple means, if the preloading is effected by a bulge transverse to the direction of extension of the spring element. Here, a wave-shaped intermediate layer, or indeed a bulge, may enter, by a strip, into a window-shaped space of the other layer. In this respect, it proves advantageous for the spring element to be held between two layers of the retaining plate. It is here advantageous that the spring element has a greater width than that of the region of the hinge-forming cooperation between closure flap and retaining plate. This is of importance above all for circular closure flaps. There, theoretically, a hinge axis including only the tangential region would suffice. Everything beyond that with regard to width provides lateral supporting bands and, with that, a wobble-free flap movement of the closure flap. Further, it is proposed that the cardboard paper material on the bearing surface of the closure flap is treated or coated for greater smoothness. By this means there is obtained a very effective valve seat surface for the closure flap. By the aforementioned smoothening, the roughness is taken from the material, that is, the surface is very largely levelled. This may be done by a press-type impression. On the other hand, however, a coating also works. This may be obtained by means of printing. In counterpart, the side opposite the bearing surface may be prepared likewise with a view to sealing contact. For this purpose, it is proposed that the retaining plate has on its outer side, in the region of the opening, a sealing surface for engagement of an axially aligned end face of a vacuum-cleaner blower connection piece. This sealing surface may be smoothingly treated or coated, in particular printed, in the same manner as mentioned. Preference would be given here to printing, since this outer side of the retaining plate is in any case printed with manufacturer's particulars, instructions for use and type designation. Moreover, it is advantageous for the opening to be additionally closable by sliding. That way, it cannot ever happen that the user, by (unintentional) reaching into the opening, may press the closure flap into the opening position. This access is in fact partitioned off. The corresponding slide securing means is the subject matter of U.S. Pat. Nos. 43 41 248.3 and 44 13 248.

Further, the invention provides the proposal that an intermediate plate is provided in the retaining plate between the slide and the closure flap, the opening being in the intermediate plate. In a vacuum cleaner with a blower, a vacuum-cleaner blower connection piece and an accommodating space for a dust filter bag, where the vacuum-cleaner blower connection piece docks in end-on engagement at a dust filter bag accommodated in the accommodating space, which dust filter bag is formed in particular as a dust filter bag, it is advantageous that a double ring seal be provided in the end edge of the blower connection piece. When ready for use, its rings come into sealing contact with the corresponding sealing surface of the retaining plate. This is such that, on corresponding engagement between the rings of the double ring seal and the retaining plate, a chamber is formed which has a passage for connection to the atmosphere. This passage may be provided in the form of ducts. Alternatively, a solution is also conceivable to the effect that the passage is defined by an unskinned portion of an open-pored foamed plastic. Finally, it further proves advantageous for the blower connection piece to have, on the end face, an annular groove to accommodate the double ring seal, whose groove base has a break-through connecting to the outer surface. After slight raising of the retaining plate the aforementioned slide can run over the ring seal thus realised in the form of an axial seal. The cutoff thus occurring with priority permits the dust filter bag to be disconnected cleanly. The aforementioned passages have the effect that, as a result of the different vacuum ranges prevailing in the device, in any leakage in the connection region, dust particles are drawn with priority into the channels leading to that region. Further, it is advantageous, in respect of the dust filter bag, for the retaining plate to have, in the region of its hinge axis, a deflecting edge overreaching the edge of the closure flap. The thus exposed deflecting edge provides, in the hinge movement, a greater extension length and therefore an increased resilience.

In a dust filter bag for a vacuum cleaner, with a retaining plate comprising a solid paper material, such as cardboard for example, to which a dust bag is joined, for example adhesively, where the retaining plate comprises a base plate, a frame portion placed on the base plate, a slide on the base plate and slideable in the frame portion defining a guide shaft, as well as a cover plate, where the cover plate has a window for reaching through to a handling end of the slide, it is further advantageous for the slide to have a smoothly formed face and to rest with this face on the likewise smoothly formed face of the cover plate. This measure increases the sliding capability of the slide and reduces the corresponding actuating forces. The one-sided smoothness may be imparted by simple means to the paper material used, such as cardboard for example. Here also there exists the possibility of an application by pressing of the corresponding end face or indeed by coating, for example lamination, printing, or the like. To optimise the increased sliding capability, a further procedure is undertaken such that the rear side of the slide is turned towards a smoothly formed face of the base plate. Moreover, it proves favourable for the outwardly-turned, face of the handling end of the slide to carry a slide entraining projection, which, with its rough face, likewise points outwards. The pressure component or displacing component lying in the opposite direction obtains the intended sliding capability, while the surface turned towards the actuating side of the slide favours grasping, whether by manual actuation or by means of an automatic opening/closing device associated with the vacuum cleaner, as is disclosed in, for example, the aforementioned U.S. Pat. Nos. 43 41 248 and 44 13 248. Further, the invention provides as a proposal that the slide has a leaf-shaped outline. That reduces its sliding surface compared with uniform width slides. It also proves advantageous for the leaf-stalk to taper towards its free end carrying the slide entraining projection and for the stalk-guiding portion of a slide guide shaft to correspond to the stalk lateral and end-outline. With actuation, the lateral edge of the stalk lifts, because of this, off the corresponding edge of the slide guide shaft. This sliding friction therefore ceases and favours the intended easy-moving displacement of the slide including at the narrow edges. This effect further finds its structural continuation in that the window also is formed as a recess corresponding to the stalk outline. Concretely, this further has the appearance that the slide entraining projection projecting into the window corresponds, in respect of its edges lying in the sliding direction, to the tapering of the window.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figures 1, 2, 3:
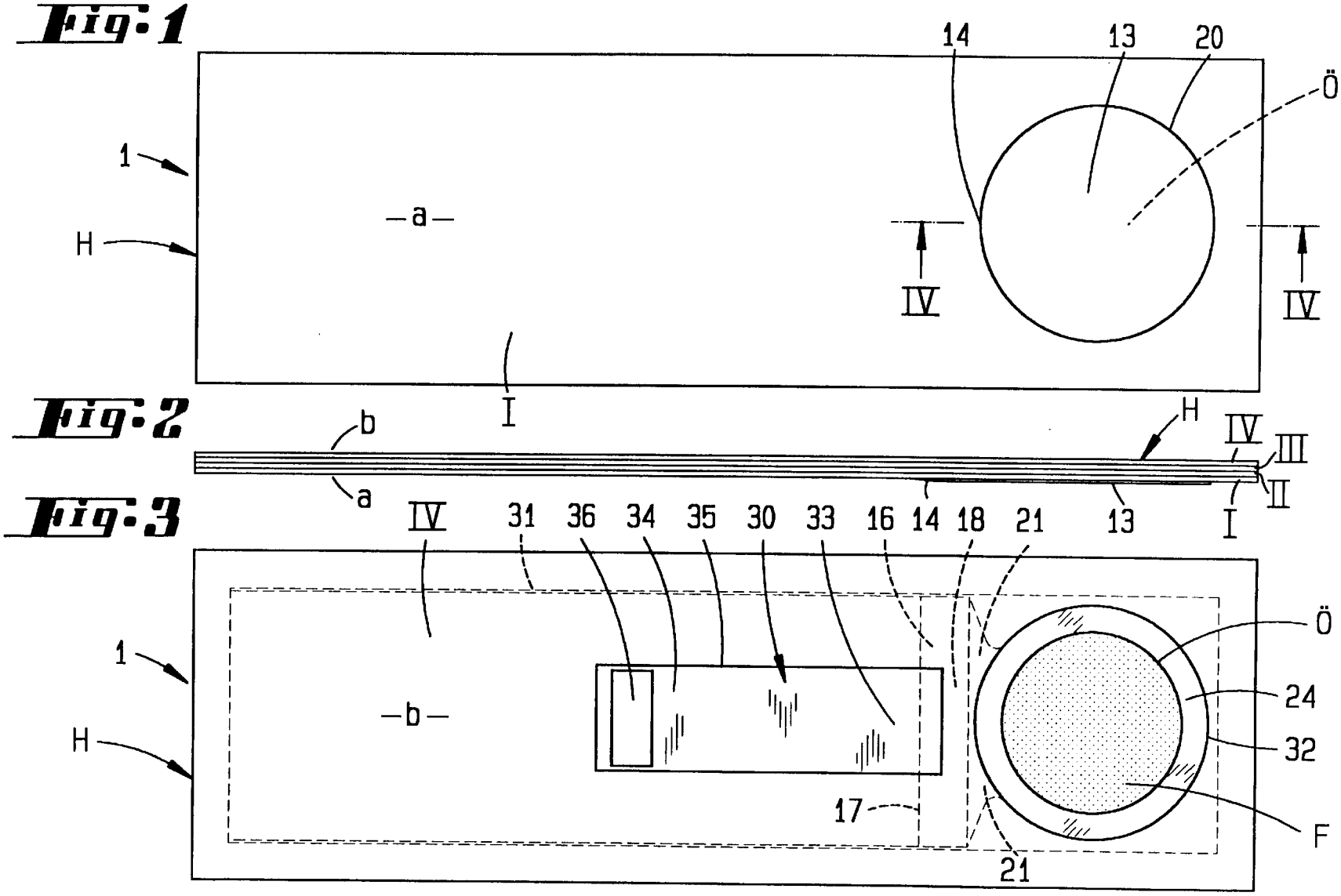
FIG. 1 is the retaining plate of the dust filter bag viewed from the inside, in closed condition, according to the first embodiment.
FIG. 2 is a side view of the retaining plate.
FIG. 3 is the retaining plate viewed from the outer side.

The dust filter bag 1 reproduced in the drawings is what is termed a non-returnable or expendable bag.

Figure 23:
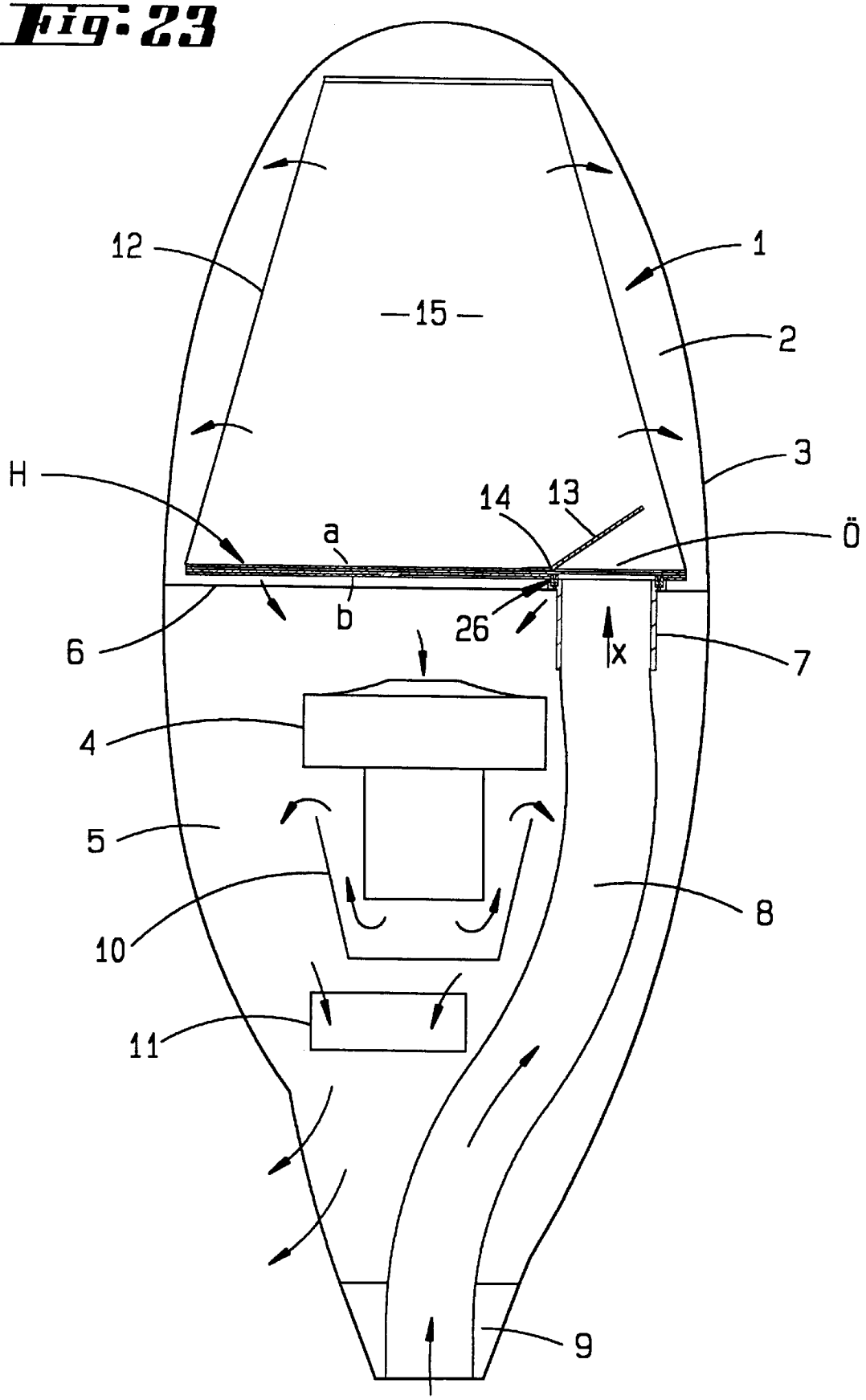
FIG. 23 is a vacuum cleaner fitted with the dust filter bag according to the invention, in very largely diagrammatic representation.
Figure 26:
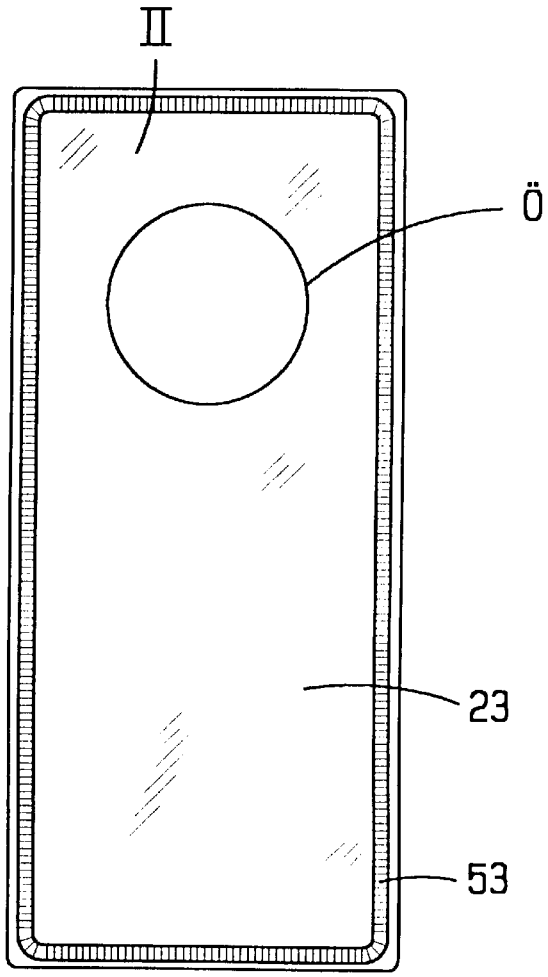
FIG. 26 is a layer of the retaining plate forming a base plate, in detailed representation.

The dust filter bag 1 is for this purpose adapted to be interchangeably arranged in an accommodating space 2 of a vacuum cleaner 3. As may be seen from FIG. 23, this may be a hand vacuum cleaner. Its blower 4 in the form of a motor/blower unit, electrically driven by means of a main connection or a storage battery apparatus, is contained in a space 5 remote from or separated from the accommodating space 2. The flow-permeable bearing wall for the dust filter bag 1 which is illustrated is indicated by reference number 6. The bearing wall 6 accommodates a blower connection piece 7 which penetrates this wall and connects to a suction channel 8. The suction channel 8 runs into a suction nozzle 9.

Beneath the blower 4 there is located an upwardly-opening flow diverter 10. Beneath this there lies an exhaust filter 11. An air exit is connected thereto.

The docking side of the dust filter bag 1 on the blower connection piece side comprises a retaining plate H. The latter is multilayered and comprises paper material such as cardboard, for example.

Over the inside a of the retaining plate H facing away from the blower connection piece 7, there extends a dust bag 12 of nonwoven material with dust-filtering effect. The dust bag 12 is fastened at the edge to the inside a of the retaining plate, for example joined adhesively. The upper end of the convergingly aligned dust filter bag 1 tapers. The dust bag 12 assumes a trapezoidal outline as seen in the viewing aspect of FIG. 23. The retaining plate H is formed basically longitudinally rectangularly. Its opening O providing the flow passage on the blowing side lies offset from the dead centre in the end region of one rectangular end zone. The opening O has a circular cross-section.

The edge of the retaining plate H may have a shape, not shown, providing a non-interchangeability of the retaining plate, with fastening portions extending beyond the attachment region of the dust bag 12, for ensuring that the dust filter bag 1 is correctly positioned in the vacuum cleaner 3.

The opening O has associated with it a closure flap 13. The geometrical hinge axis 14 of the closure flap 13 is located on the side of the opening O nearer to the dead centre of the retaining plate H. The hinging is such that the closure flap 13 opens up towards the inside 15 of the dust bag 12. This occurs under the effect of the blowing air flow in the direction of the arrow x, and occurs against a spring action which endeavours to hold the closure flap in the closed condition, in which closed condition the closure flap 13 keeps closed the opening O in the retaining plate H.

The provision of the hinge axis and spring action result from one single component. Serving this purpose is a band-type spring element F. This spring element F is attached to the closure flap 13 and anchored to the retaining plate. The attachment is such that, in the closed condition of the closure flap 13 (see FIG. 4), a clearance y is formed between a band plane E—E and the hinge axis 14 of the closure flap 13 which lies outside the band. The clearance y lies transverse to the plane of extension of the retaining plate H. The hinge axis 14 is turned towards the inside 15 of the dust bag 12, therefore lying on the inner side a.

The spring element F formed as a band is located on an outwards turned, that is, towards the outer side b of the retaining plate H, first surface 13' of the closure flap 13. The second surface of the closure flap 13 turned towards the inside 15 is called 13".

The band-type spring element F is attached, on its closure-flap side, to the surface 13', for example by adhesion.

A portion of the band-type spring element F lying on the other side of the hinge axis 14 is fastened to the retaining plate H and referred to as captive end 16. As may be understood from the drawings, the spring element F and the captive end 16 provided thereon are held between two layers I, II of the multilayer retaining plate H. The fixing may occur there by adhesion and/or stitching. The capture location 17 of the captive end 16 lies distinctly spaced apart from the hinge axis 14. There thus remains, between the hinge axis 14 and the aforementioned capture location 17, a non-captive portion of the band as extension reserve 18. This extension reserve 18 is necessary right at the beginning of the opening-up movement of the closure flap 13. Reference is made to the opening condition reproduced in dot-dash type line in FIG. 4. There, a spring-element band portion 18' extends freely or bridgingly over the exit of the V-shaped valley-like hinge gusset. 14 is the hinge-gusset angle point.

The spring element F is an elastic, for example rubber-elastic, impermeable band element, which, in resilient, extended condition in the closed position, that is in the closed condition of the closure flap 13, connects the latter to the retaining plate H. The spring element F may be comprised of rubber. Also conceivable are thermoplastic elastomers, for example SEBS, EPDM. A preloading is therefore present. This preloading is predeterminable by choice of the capture location 17. In the order of magnitude represented, it is sufficient for the band element, namely spring element F, to have a preloading corresponding to approximately 10% of the elastic extension reserve, in the closed position of the closure flap 13.

There is thus produced a pressure force, which makes secure the sealing of the opening O, especially since the spring element F, on account of the rubber-elastic material, is formed as a layer element substantially entirely overlapping the first surface 13'. This layer element is drawn forward to the periphery of the closure flap 13. There is thus produced, on the closure-flap side, an edge seal D.

Opposite the edge seal D there lies a bearing surface 19 of the retaining plate H. This bearing surface 19 is formed by the layer II of the retaining plate H. It (19) extends as a circumferential annular shoulder concentric with the opening O, the inside diameter of which annular shoulder is smaller than the opening 20 in layer I of the retaining plate H. The closure flap 13 is matched to the profile of the opening 20, the circumferential face edge 13'" of the closure flap 13 is therefore held supported against the bearing surface 19, naturally with allowance for a freedom of movement, maintaining the flap capability of the closure flap, at that side or arc-half of the basically circular closure flap which lies diametrically opposite the hinge point 14.

Because the face edge 13'" is merely in contact, the hinge point is floating and self-adjusting.

Since the spring element F, as is to be seen from the drawings, has a greater width than that of the region of the hinge-like cooperation between closure flap 13 and retaining plate H, there remain lateral, band-like hinge gussets 21, which stabilise the folding direction of the closure flap 13. There is no loss of the congruence between opening O and closing closure flap 13.

Figure 7:
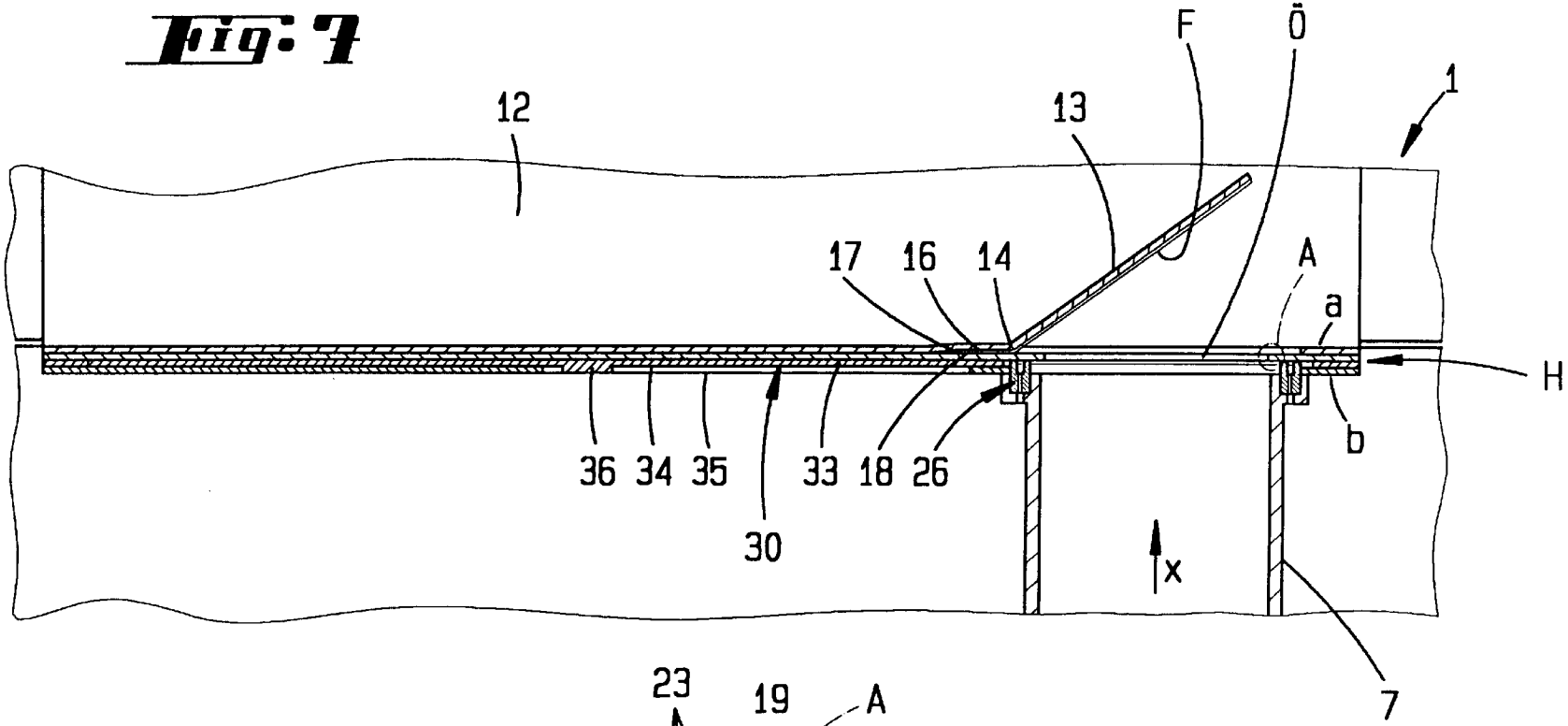
FIG. 7 is the dust filter bag in longitudinal section with closure flap opened by the blowing air.
Figure 8:
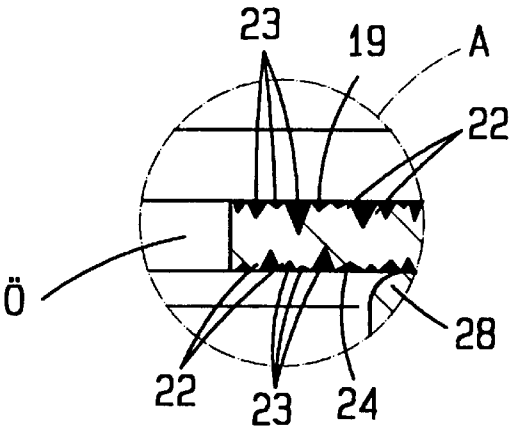
FIG. 8 is the position marked A in FIG. 7 in enlargement from same.

The bearing surface 19 defining the flap-abutment of the spring-biased closure flap 13 is developed so as to provide the edge seal D. The development consists in that the cardboard paper material, that is the layer II, is treated or coated at the bearing surface 19 with a view to greater smoothness. Reference is made to the FIGS. 7 and 8. There, there is shown, from the correspondingly enlarged extract A, the roughness designated 22 of the bearing surface 19. The roughness 22 represented by exaggerated, fantastic relief structure may be smoothened by stamping pressure or, as seen in FIG. 8, by a coating 23 (black pinch-outs). The roughness 22 is filled by the coating. Preferably, this is effected by an imprinting of the bearing surface 19.

A corresponding sealing measure is carried out also in respect of the under side, in the region of the docking zone of the blower connection piece 7. The docking zone of the retaining plate H has, on the outer side b turned towards the blower connection piece 7, a sealing surface 24 for contact with an axial seal. The axial seal is located on an axially aligned, that is pointing in the direction of the opening O, end face 25 of the vacuum-cleaner blower connection piece 7.

The axial seal is formed by a double ring seal 26, which is let into a corresponding annular groove 27 lying on the end face of the blower connection piece 7.

In respect of the double ring seal 26, this consists of an element which is U-shaped in cross-section. Its U-shaped opening points upwards, as do also the two sealing lips 28 and 29 formed by the U-shaped arms.

The upwardly-directed ends of the sealing lips 28,29 are rounded as seen in section and, in operational association of the dust filter bag 1 or the retaining plate H respectively, come closingly against the corresponding, under-side sealing surface 24, which lies vertically opposite the bearing surface 19. The sealing surface 24 is smoothened in the same manner as the bearing surface 19. The terms and reference numbers are to be understood correspondingly.

The side of the opening O turned towards the blower connection piece 7 may be closed by a slide 30. This slide 30 is guided beneath the layer referred to as II. To form a guide shaft 31 for the slide 30, two further layers, designated III and IV are associated with the retaining plate H. The corresponding laminate may be clearly seen in FIG. 4. While the third layer III adjoining the layer II forms the slide slot reaching into the region of the opening O, the fourth layer provides the floor of the guide shaft 31, naturally leaving an opening 32 concentric with the opening O or opening 20. The opening 32 is so dimensioned in its inside diameter that the double ring seal 26 can pass through, to enter into sealing engagement with the sealing surface 24.

Figure 9:
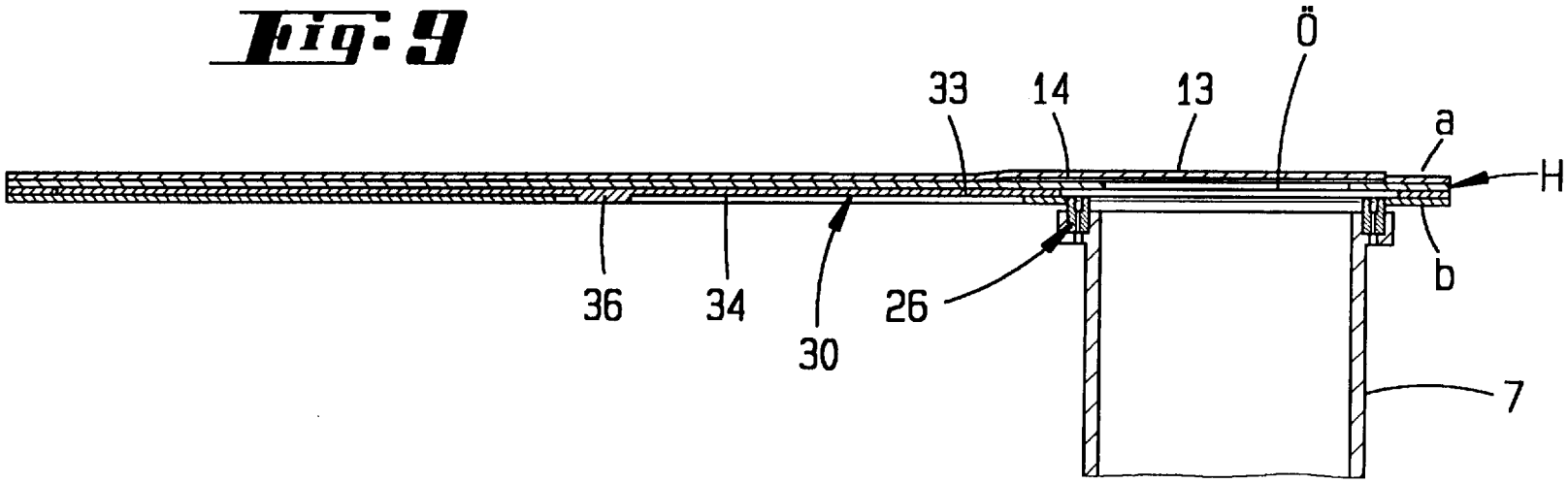
FIG. 9 is a longitudinal section with docking position slightly raised opposite the blower connection piece, so that the slide, running over the double ring seal there, finds space.

For actuating accessibility of the slide 30 having a closing end 33 and a handling end 34, the undermost layer IV has a window 35. Into this window there extends a slide entraining projection 36 for an automatic actuating device, as disclosed in the aforementioned U.S. Pat. Nos. 43 41 248 and 44 13 248. For the slide 30, a limit-stop is provided which sets the stroke travel, enabling a complete closing of the opening 0. To initiate the slide closure, the retaining plate H, as is recognisable from FIG. 9, is lifted slightly upwards away from the blower connection piece 7 namely just so far that the slide 30, functioning like a cigar cutter, may run freely over the head of the sealing lips 28, 29. The outer lip 29 here still continues to seal against the opening 32. Emergence of dust is thus avoided.

Figure 10:
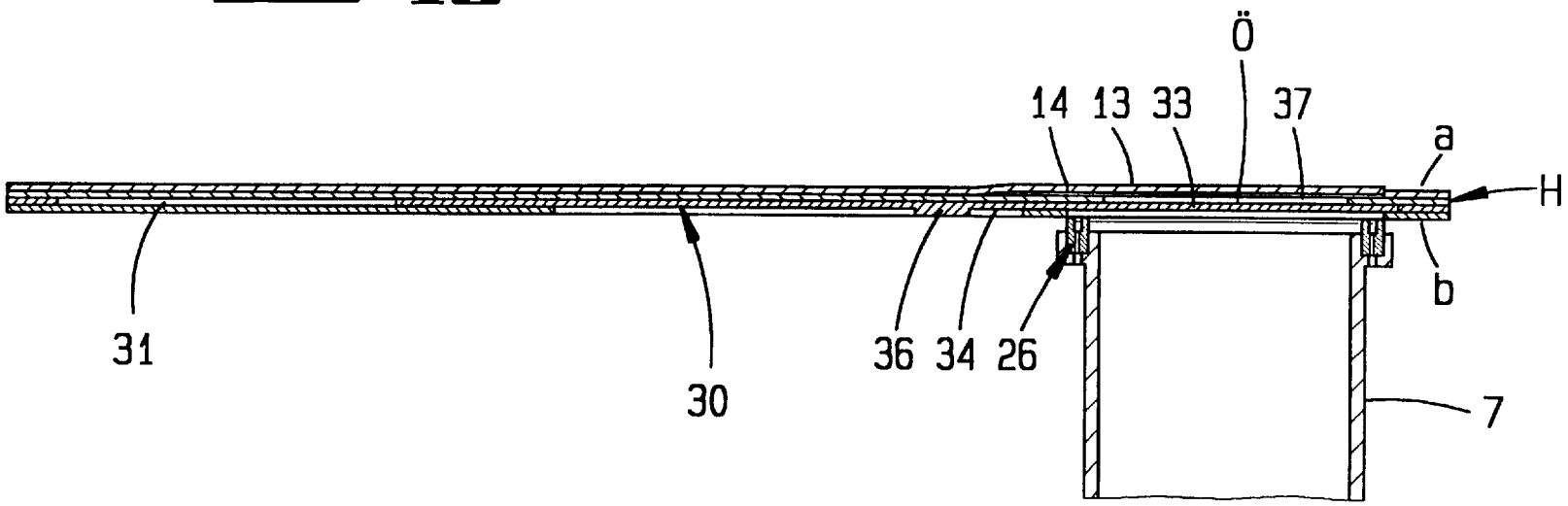
FIG. 10 is the section as in FIG. 9, but with slide now closing the opening.

FIG. 10 shows the closed position of the slide 30 and the clearance between the end face 25 (cf. FIG. 4) and the retaining plate H further enlarged. In this position, the superimposed sealing is no longer required. Any dust particles lying in between are held back by a small intermediate chamber 37, which is formed out of the cavity, closed on both sides, of the opening O. In slide-closed condition, not even a chance contact by finger or the like can pivot the closure flap 13 accidentally to the inside 15 of the dust bag 12. With regard to the provision of an intermediate chamber 37, the second layer II may be regarded as an intermediate spacer plate.

The dust bag 1 according to the second embodiment is in principle of the same construction; but we are here concerned with a slide-free solution. The reference numbers are applied correspondingly, namely without textual repetitions.

Figure 21:
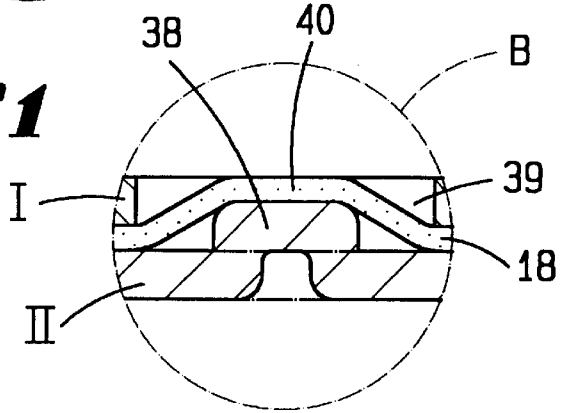
FIG. 21 is the detail marked B in FIG. 20, in enlargement.

Basically, this embodiment is manageable with two layers I, II, which hold between them the spring element F, again leaving the above-mentioned extension reserve 18. In this arrangement, the preloading is effected in the course of the sandwich-like assembly of the two layers I, II. This is effected by changing of the usual course of the layer element forming the spring element F. Concretely, the procedure is such that the preloading is effected by a bulge transverse to the direction of extension of the spring element F (see FIG. 21). The lower layer II forms, for this purpose, a strip 38 running transverse to the longitudinal extension of the retaining plate H. In the extension region of the aforesaid strip 38, there lies a recess or transverse slot-like break through 39, which accommodates the bulged portion and thus pre-extends the layer element, so that the hinge-axis end face edge 13''' of the side or arc-half of the closure flap 13 there is drawn firmly against the edge zone of the opening 20 there, by the effect of the desired closing component of the closure flap 13. As can further be seen from FIG. 21, the bulged portion 40 undergoes a trapezoidal diversion.

The strip 38 can be realised by placing of an appropriately shaped cross-member (dot-dashed version) or, as represented in extract, by stamping the relevant portion of the layer II in the direction of the breakthrough side.

Figure 12:
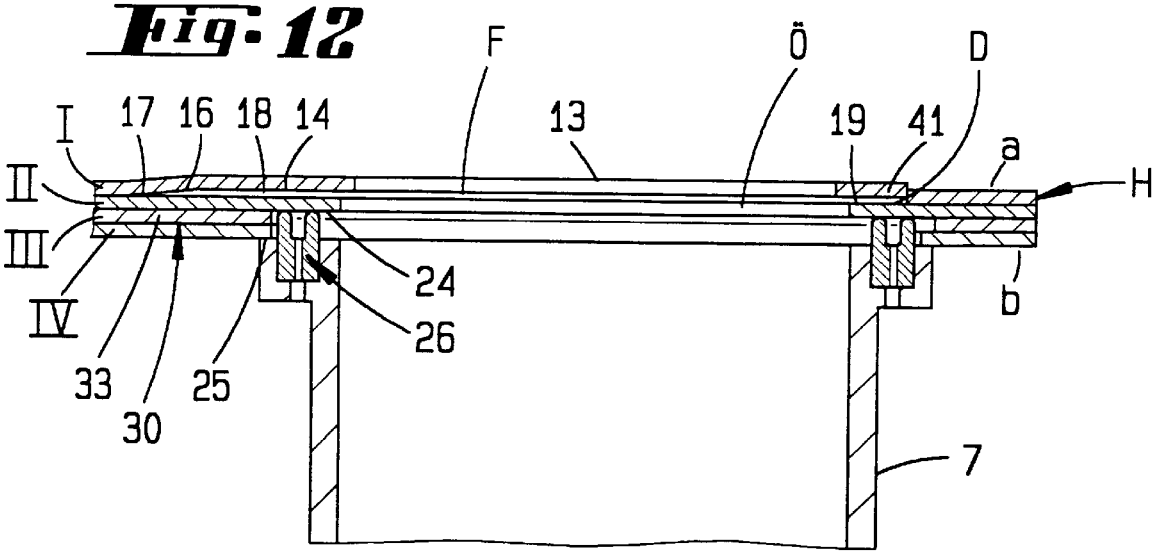
FIG. 12 is the section according to Line XII—XII in FIG. 11, docked and with slide withdrawn.
Figure 11:
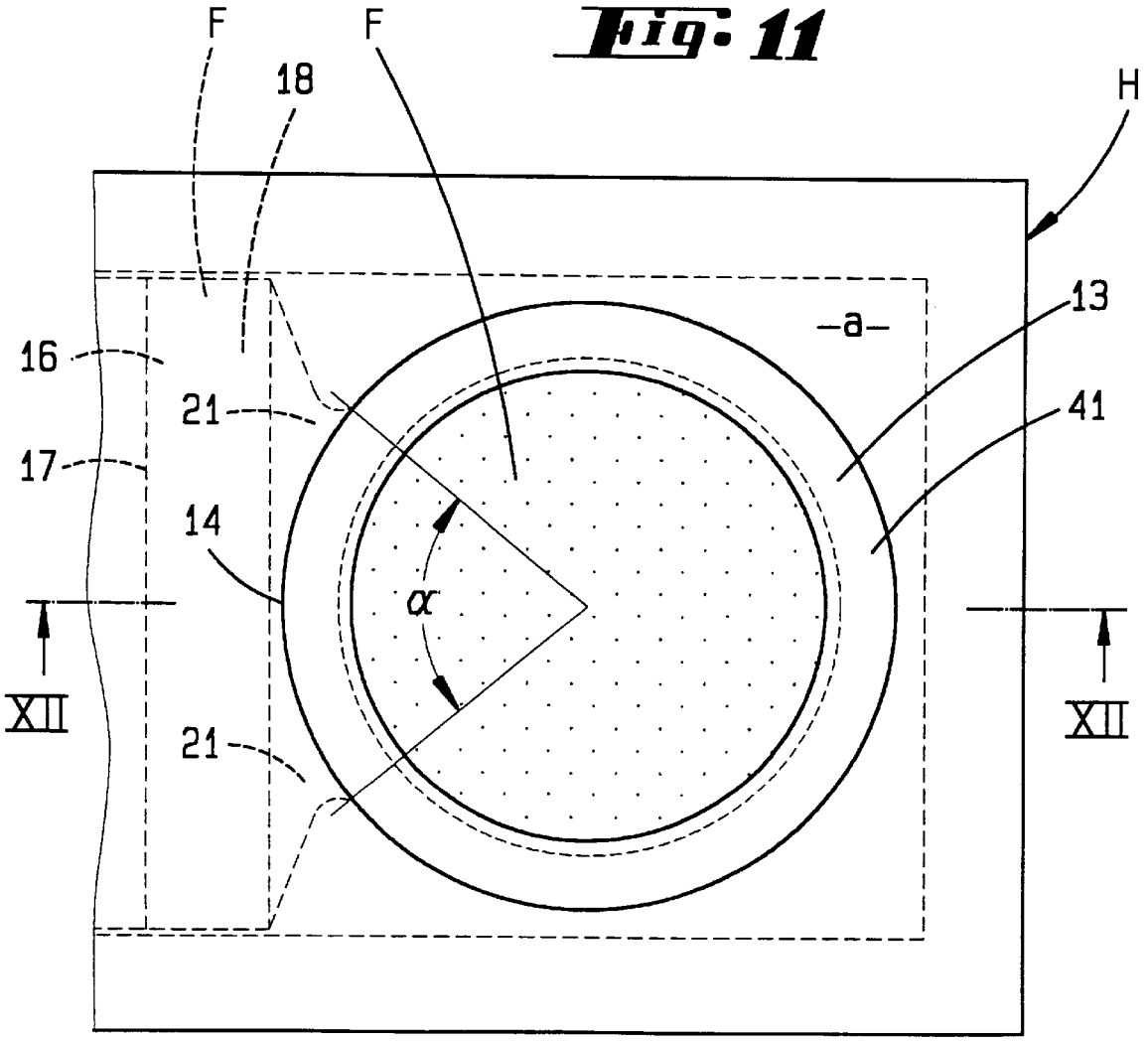
FIG. 11 is the plan view of the opening-side region of the dust filter bag, with representation of a first variant of the closure flap (annular)

Of the first variant (FIGS. 11 and 12), it still remains to be said that the closure flap 13, there, does not, as above, comprise a disc-shaped cardboard body, but an element formed as a ring 41. The spring element F or layer element here cut to the appropriate shape now acts like a drumskin closing the ring hole. Also in this variant, there are formed the above-indicated hinge gussets 21, which, over an angle region Alpha of about a quarter circle, run into the periphery of the ring. Furthermore, the hinge gussets 21 widen in the direction of the longitudinal edges of the retaining plate H. That produces an altogether quite large-surfaced captive end 16 of the spring element F.

Figure 14:
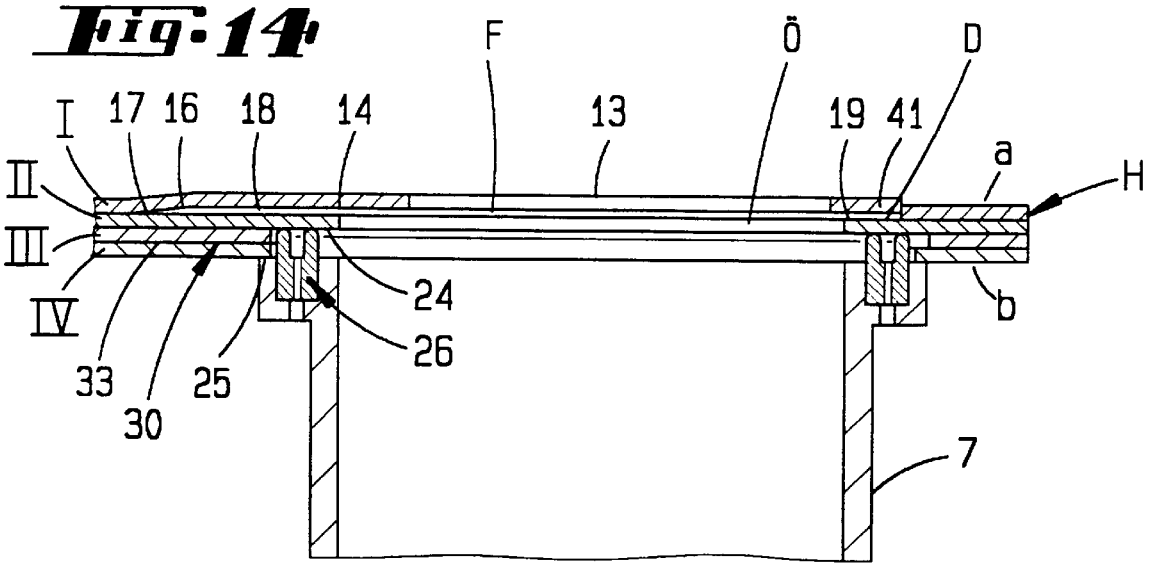
FIG. 14 is the section according to Line XIV—XIV in FIG. 13.
Figure 13:
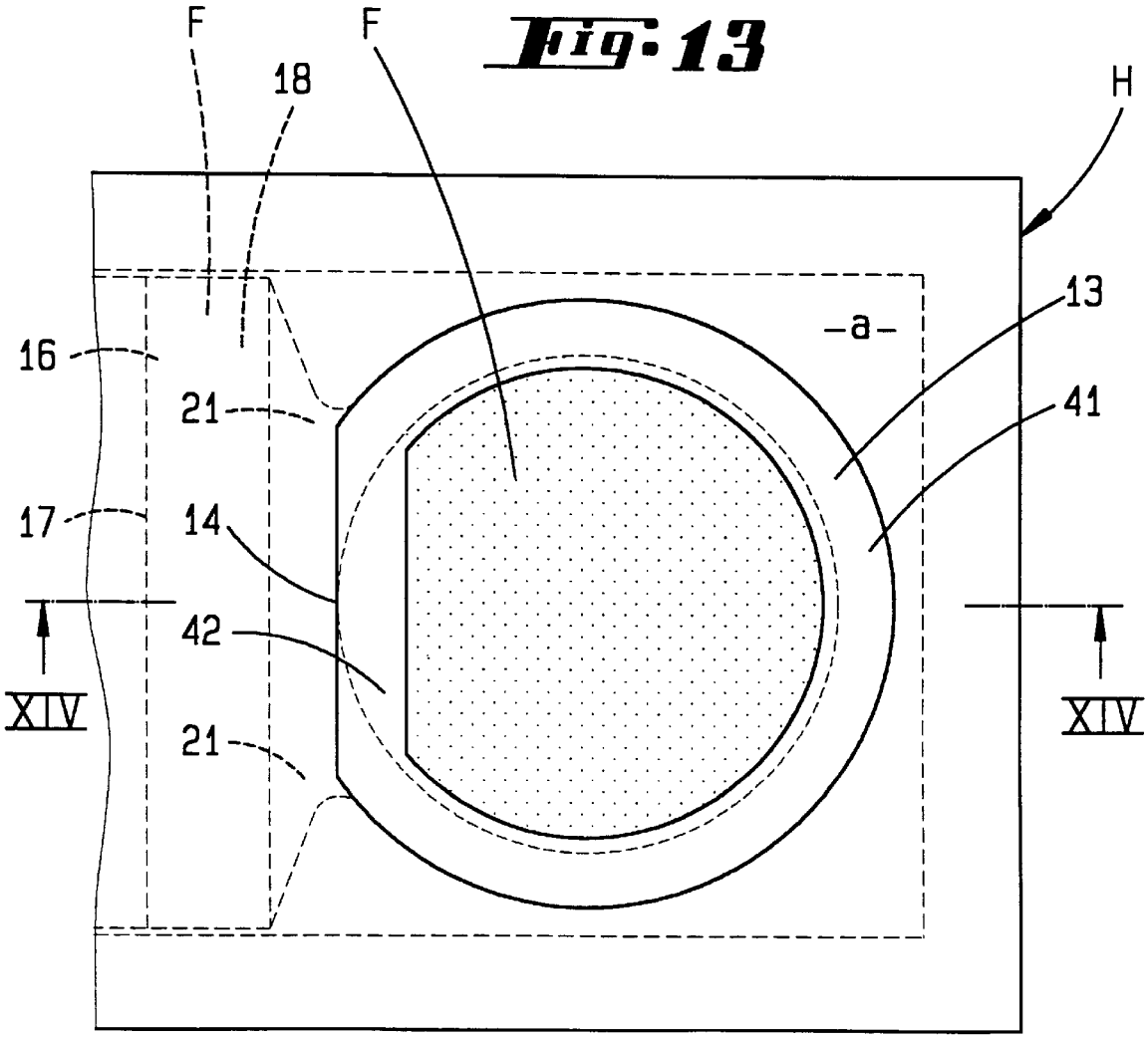
FIG. 13 is a representation as in FIG. 11, but of a second variant of the dust filter bag (secant-shaped hinging of the closure flap)

The second variant (FIGS. 13 and 14) differs from the first only in that the geometric hinge axis 14 is not formed in the region of a pure tangent of the longitudinal centre plane of the retaining plate H, but in a secant. This leads to a distinct lengthening of the hinge axis 14 formed there. The pure ring shape is thus abandoned in the hinging region, in that there lies, there, a frame arm 42 running in parallel with the hinge axis. A shield-shaped outline form could also be used here. The flat portion would lie turned towards the hinge axis 14.

Figure 15:
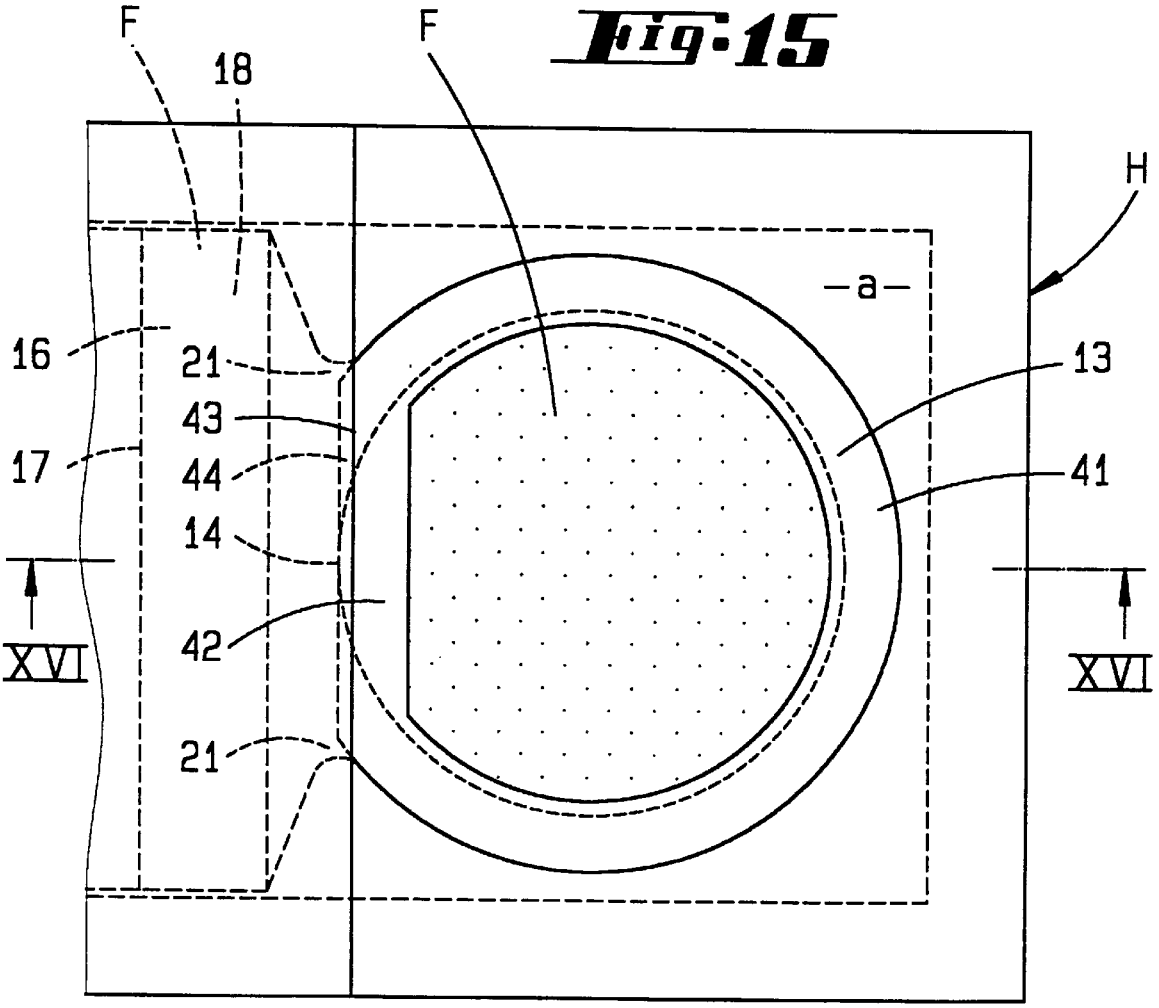
FIG. 15 is a representation corresponding to FIG. 13, reproducing a third variant of the subject matter of the invention (hinge point with deflecting projection)
Figures 17, 18, 19:
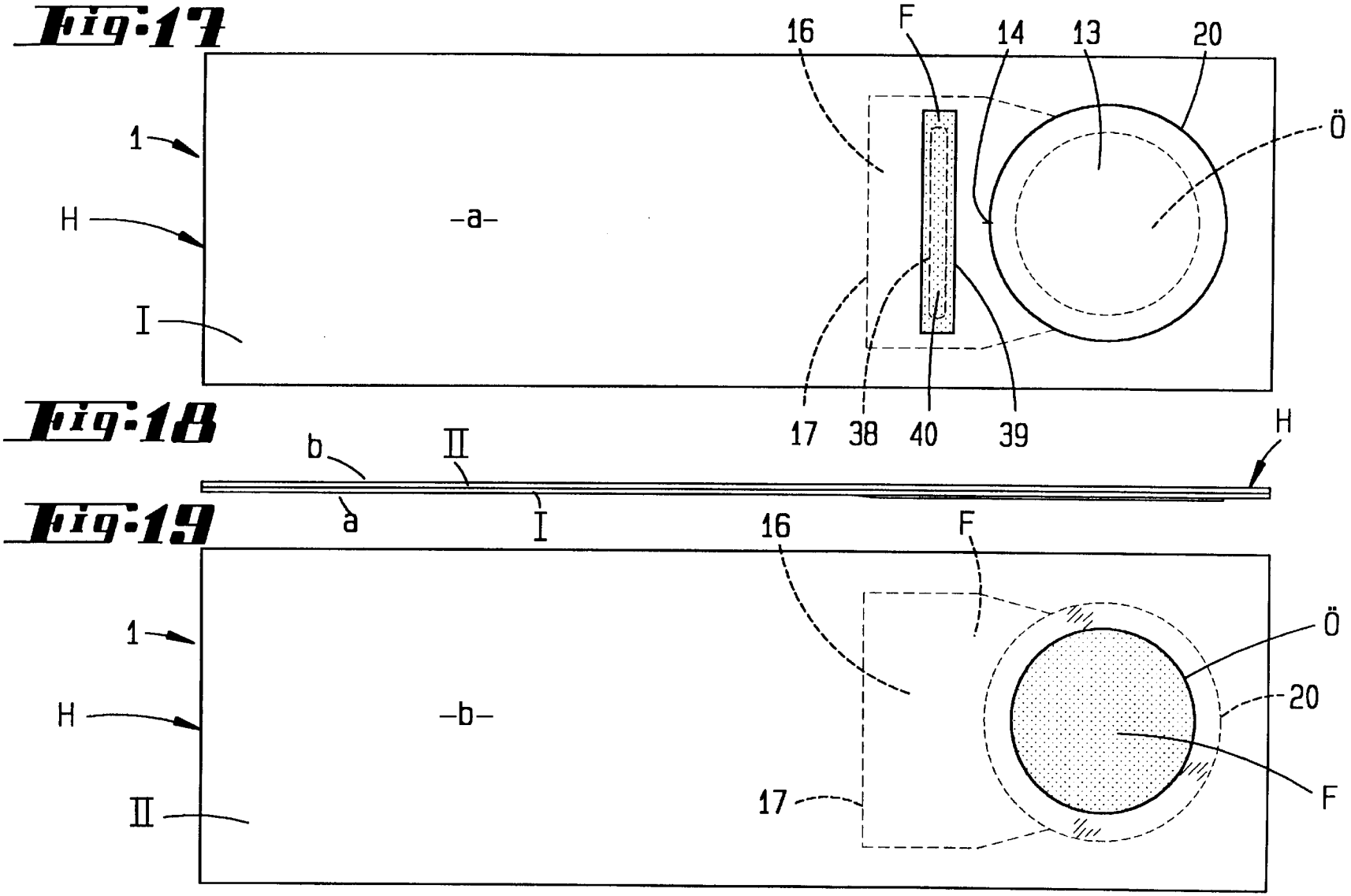
FIG. 17 is the retaining plate viewed from the inside, in closed condition, according to the second embodiment (slide-free)
FIG. 18 is a side view of the above.
FIG. 19 is the retaining plate viewed from the outer side.
Figure 20:
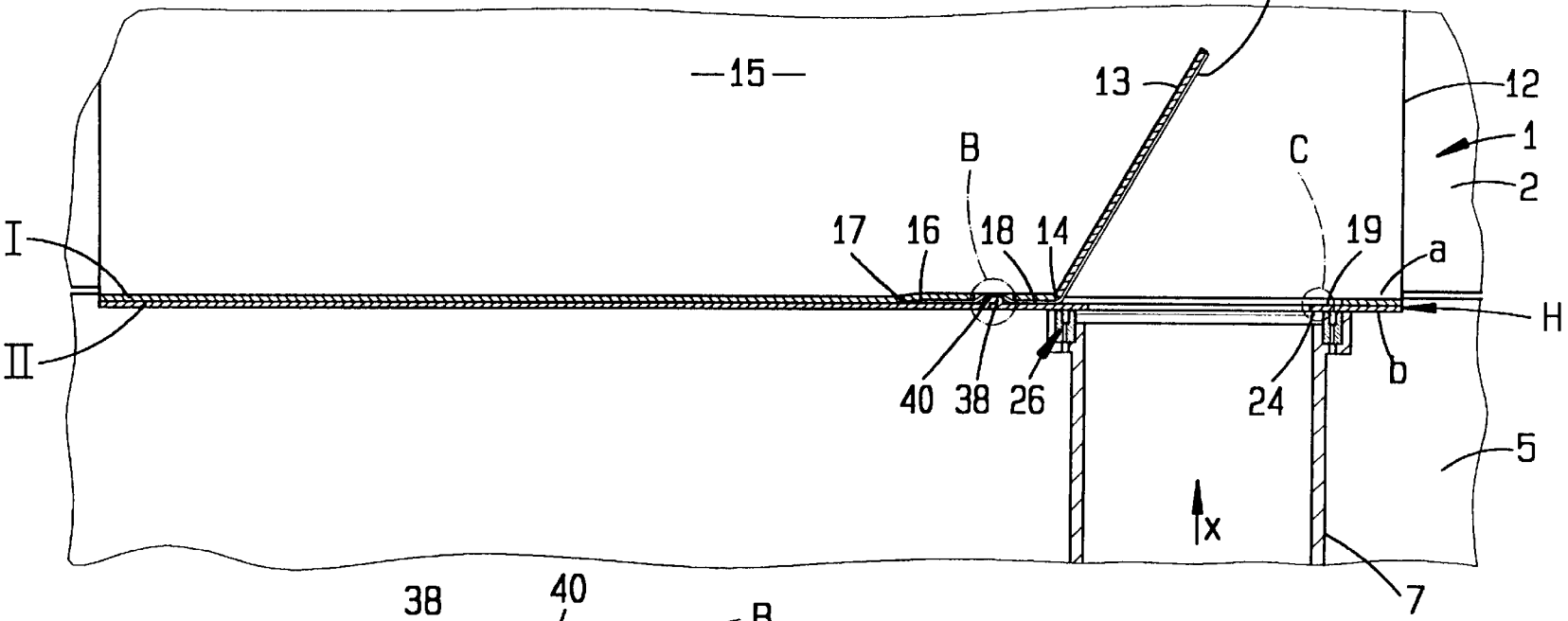
FIG. 20 is the operationally connected dust filter bag in longitudinal section, namely with closure flap opened by the blowing flow.

As far as the third variant (FIGS. 15 and 16) is concerned, there is mounted there, on the retaining plate H, inside of the dust bag 12, a further, fifth layer V, but this projects slightly, on the hinge side, over the frame arm 42 likewise provided there. Obviously, a frame arm is not essential, the closure flap 13 here may also comprise a disc element instead of a ring.

Figure 16:
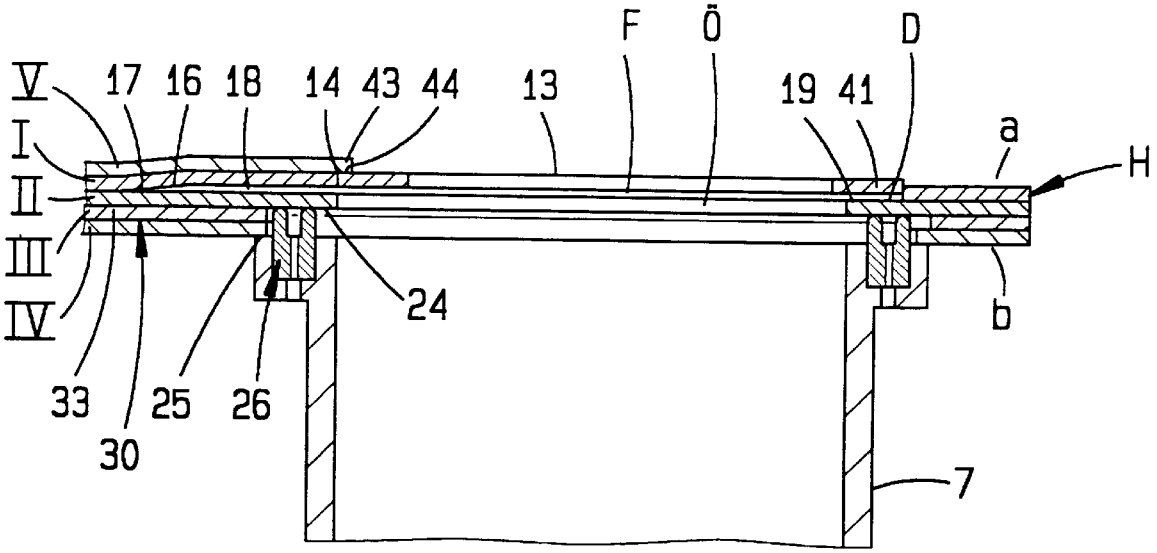
FIG. 16 is the section according to Line XVI—XVI in FIG. 15.

FIG. 16 makes it particularly clear that the end of the layer V pointing in the direction of the opening O provides an exposed deflecting edge 43. The corresponding projection causes a longer extent of the extension reserve 18 and, with that, a stronger restoring force in the sense of the spring-biased closing of the closure flap 13, which, moreover, at least in this region, is even still held positively in a U-shaped space 44. A certain flow strength is therefore already required, to put the hinge into effect. After leaving the U-shaped space 44 between 43 and F, there is then a greater ease of movement of the flap movement of the closure flap 13, whose edge portion on the hinge-axis side acts like a noncircular cam.

The three variants mentioned are to be attributed to the first embodiment, since they have a slide 30.

It still remains to be noted that the preloading of the spring element F is also achievable by partial contracting of the band, this with utilisation of the accessibility via the described break-through 39.

Returning to the axial seal formed as double ring seal 26, the latter, in sealing position (FIG. 4), leaves a chamber 45, between the two sealing lips 28,29. This chamber 45 runs around free of interruption and is in connection with a passage 46. There may be several thereof. By this means, the chamber 45 is in connection with the atmosphere.

Figure 4:
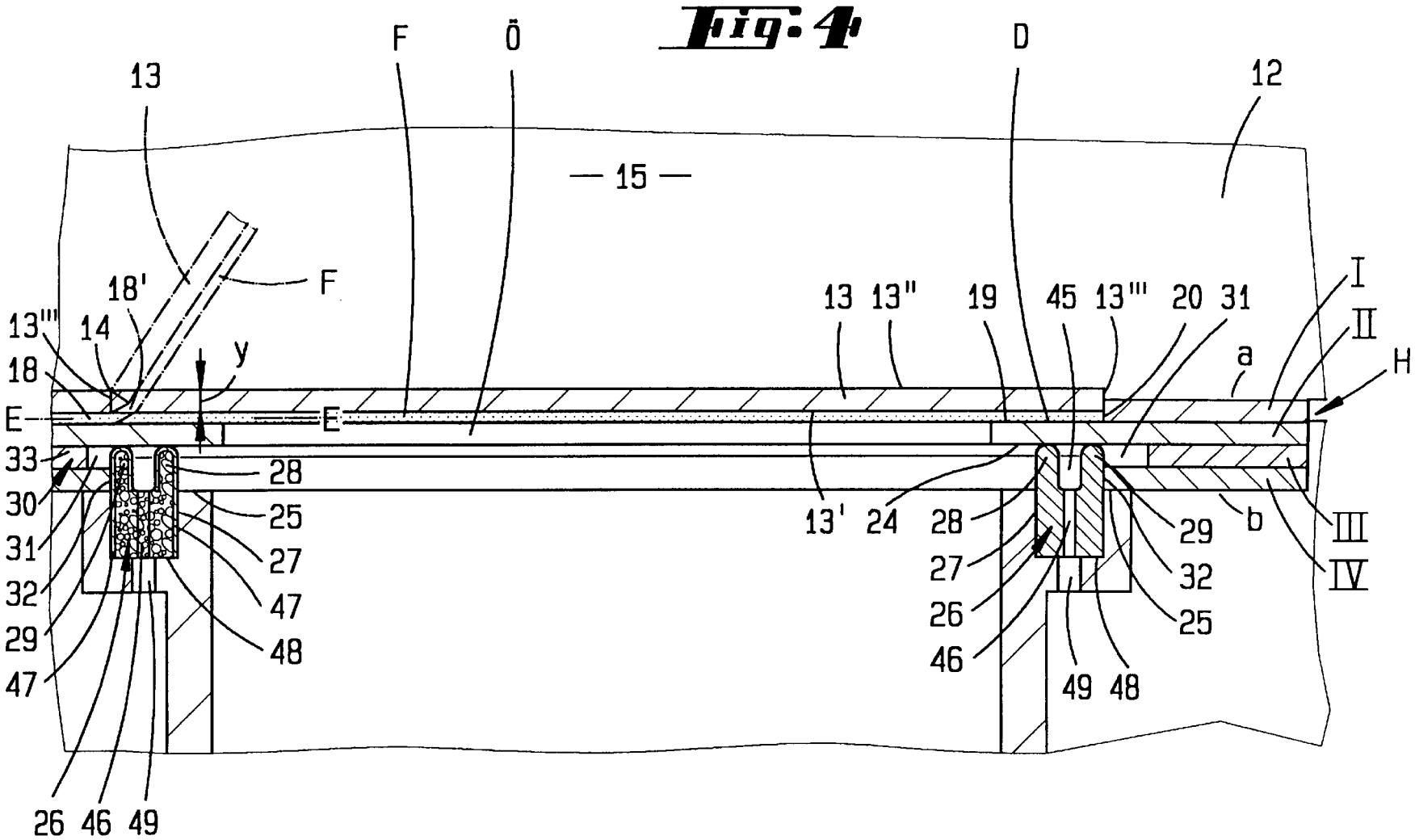
FIG. 4 is the section along Line IV—IV in FIG. 1, enlarged compared with FIG. 1, completed by the dust bag and operationally connected to the vacuum cleaner.
Figure 5:
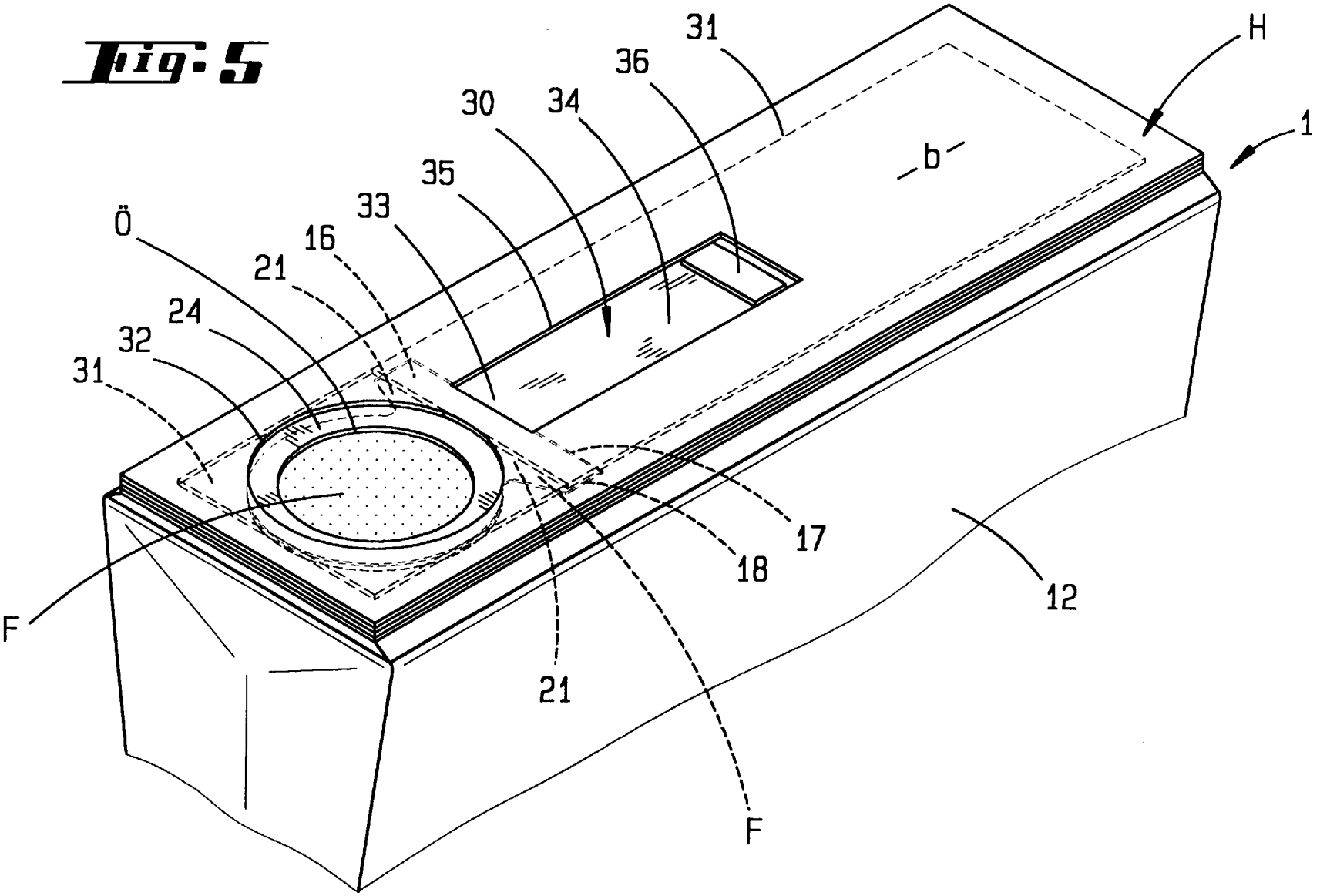
FIG. 5 is the dust filter bag in perspective representation with an opening cleared with respect to a slide and in the closed condition of the closure flap.
Figure 6:
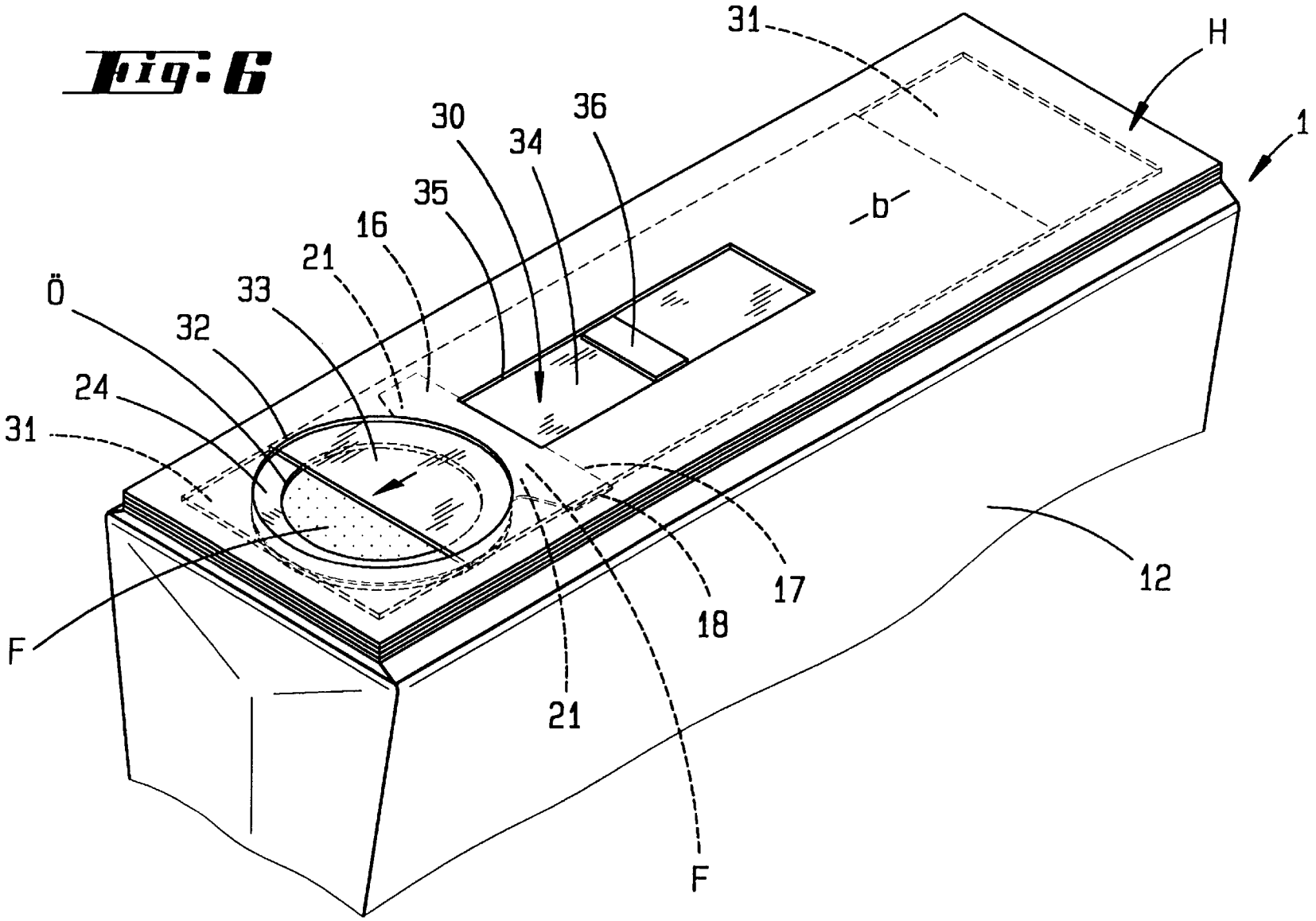
FIG. 6 is a representation corresponding to FIG. 5 in the course of closing the aforesaid opening.

According to the embodiment represented on the right in FIG. 4, the passages 46 are realised in the form of ducts in the rubber-elastic sealing ring.

With regard to the embodiment of the double ring seal 26 on the left, the passage 46 comprises an unskinned portion of an open-pored, elastic foamed plastic. The peripheral skin bears the reference number 47. The peripheral skin 47 covers the outer surface of the sealing lips 28 and 29 hermetically and extends inside the chamber 45 down to the foot, there, of the sealing lips 28 and 29. The base of the chamber 45 is, on the contrary, open-pored, precisely for the purpose of forming the passage 46 there.

To guarantee the connection to the atmosphere on the side of the blower connection piece also, break-throughs 49 issue from the groove base 48, opening towards the outer surface of the blower connection piece 7. This has the effect that when, on account of the vacuum differences in the suction channel 8 and in the surroundings of the docking zone of same, dust particles become free, these dust particles are led in the direction of the vacuum, that is, with a seal which is not entirely closed, they enter into the suction flow.

The adhesive layers joining the individual layers I–V to one another are not represented.

The last variant represented in FIGS. 24 to 32 provides—with or without closure flap 13—a development relating to the slide 30. As far as structural identity otherwise exists, the reference numbers are used correspondingly, some without textual repetitions.

Figure 22:
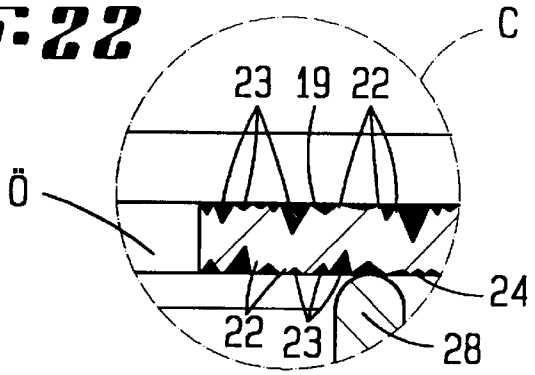
FIG. 22 is the detail marked C in FIG. 20, in enlargement.

The material forming the retaining plate H here also comprises a solid paper material, such as cardboard for example, however, here at least one side is formed smoothly. The smoothness is represented by a levelling structure, as already seen in FIGS. 8 and 22.

Figure 31:
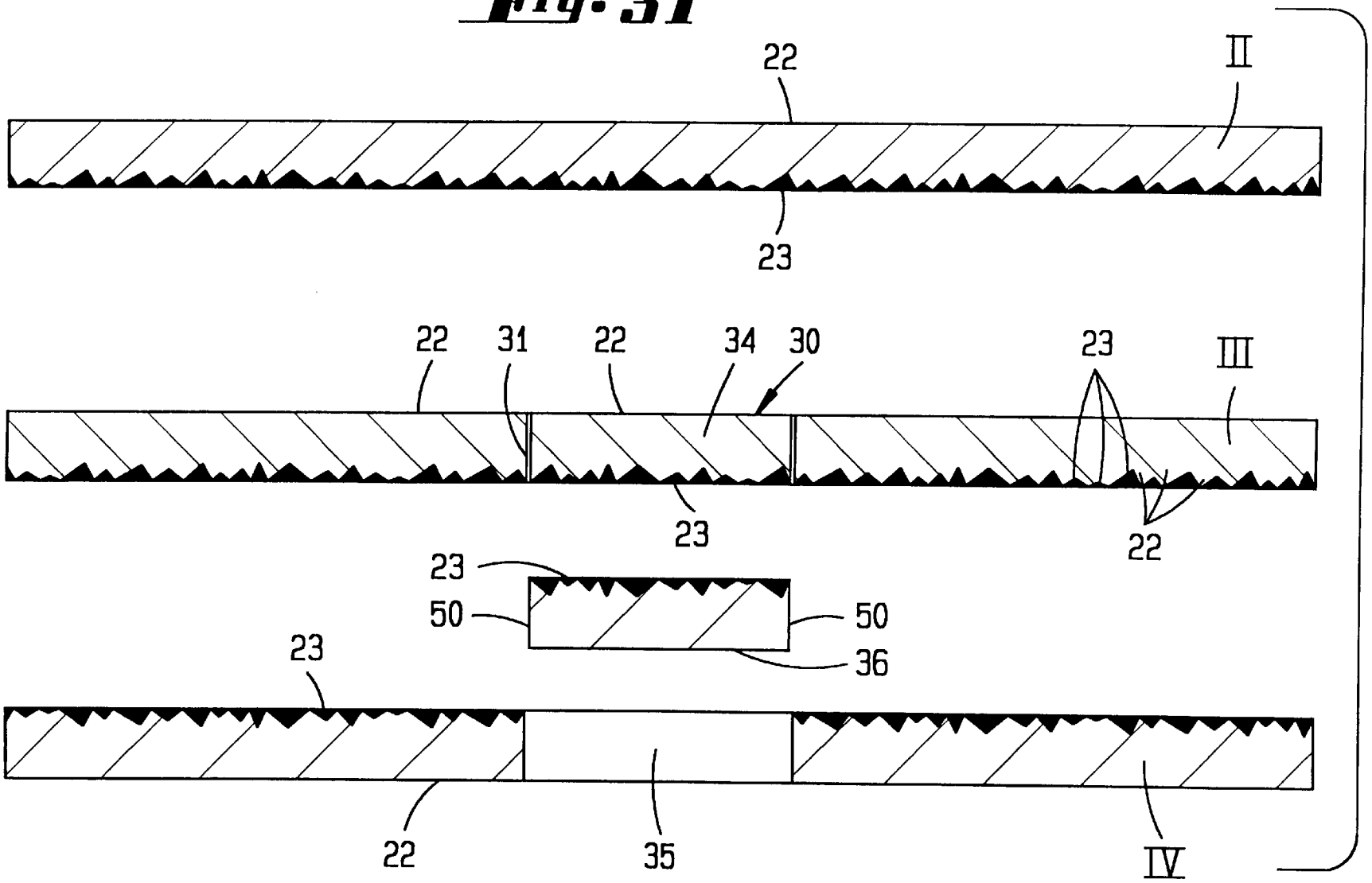
FIG. 31 is the individual layers in position assembled one above the other to form the retaining plate, greatly enlarged in thickness to illustrate the smoothening, and not yet in superimposed position, also in sectional representation according to Line XXXI—XXXI in FIG. 27

The face of the individual layers not marked with the black pinch-out or coating 23 is deemed less smooth or rough. The layers layered on top of one another according to FIGS. 24 to 26 to form an assembly or a retaining plate H, are turned with their smooth side towards the observer. FIG. 31 provides information in respect of the orientation of the individual layers II to IV. We are here concerned with, in this sequence, a base plate, a frame portion and a cover plate.

Adhesively joined together, the components are added in such a way that the slide 30 with its smoothly formed face, for example with a coating 23, lies on a likewise smoothly formed face of the cover plate, formed by the layer referred to as IV. The slide 30 can be correspondingly easily displaced; the roughness 22 with braking effect is not present in this joint region of the layers III–IV. With regard to the forceful attachment of the dust filter bag 1, the load acting via the layer II lying above also has no disadvantageous effect, especially since there is a development to the effect that the rear side of the slide 30 is, in turn, turned towards a smoothly formed face, namely towards the base plate extending above it, formed of the layer II. The relevant smoothening is again referred to as 23.

Figure 25:
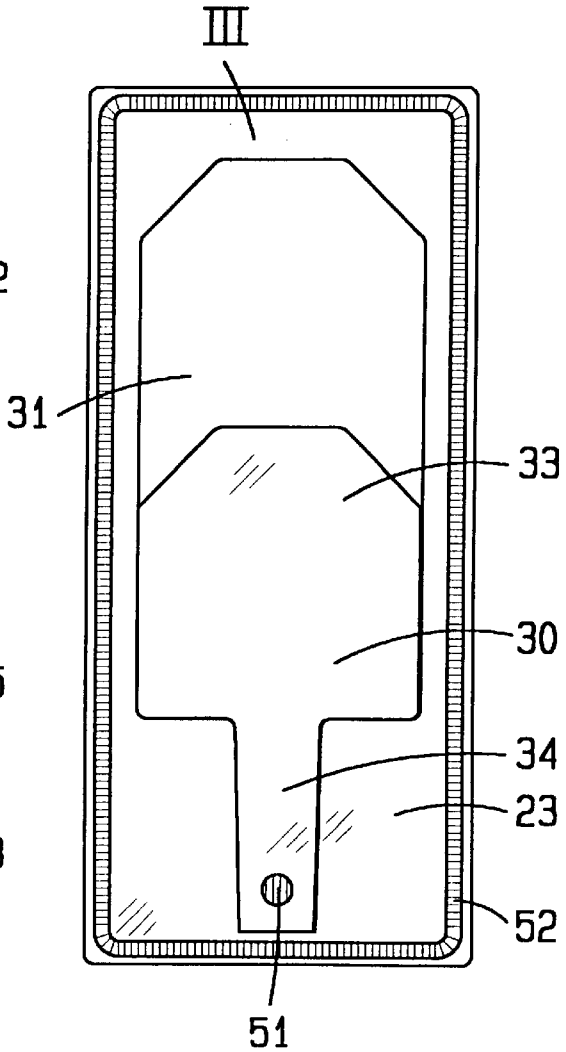
FIG. 25 is a layer forming a frame portion plus slide, in detailed representation.
Figure 24:
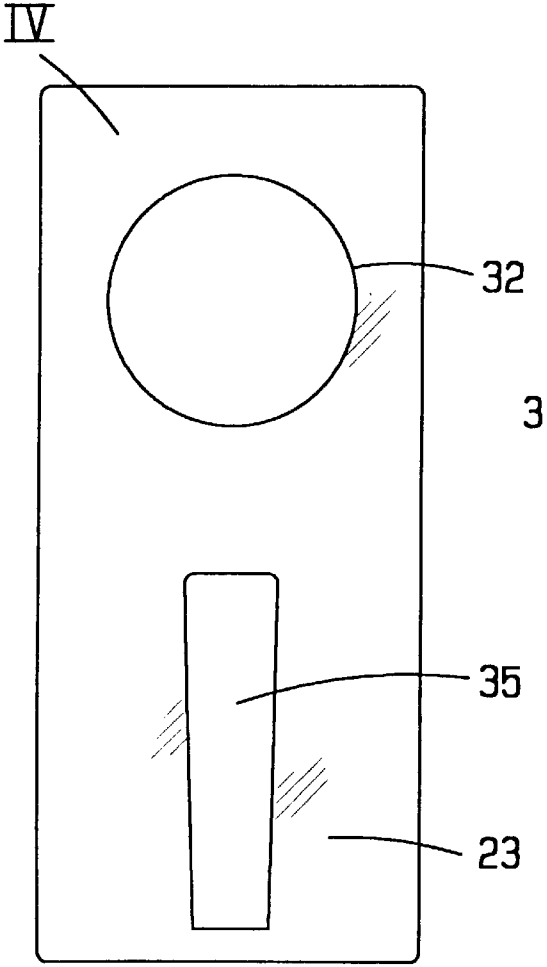
FIG. 24 is, in plan view, a layer forming a cover plate of the retaining plate, in detailed representation.
Figures 27, 28, 29, 30:
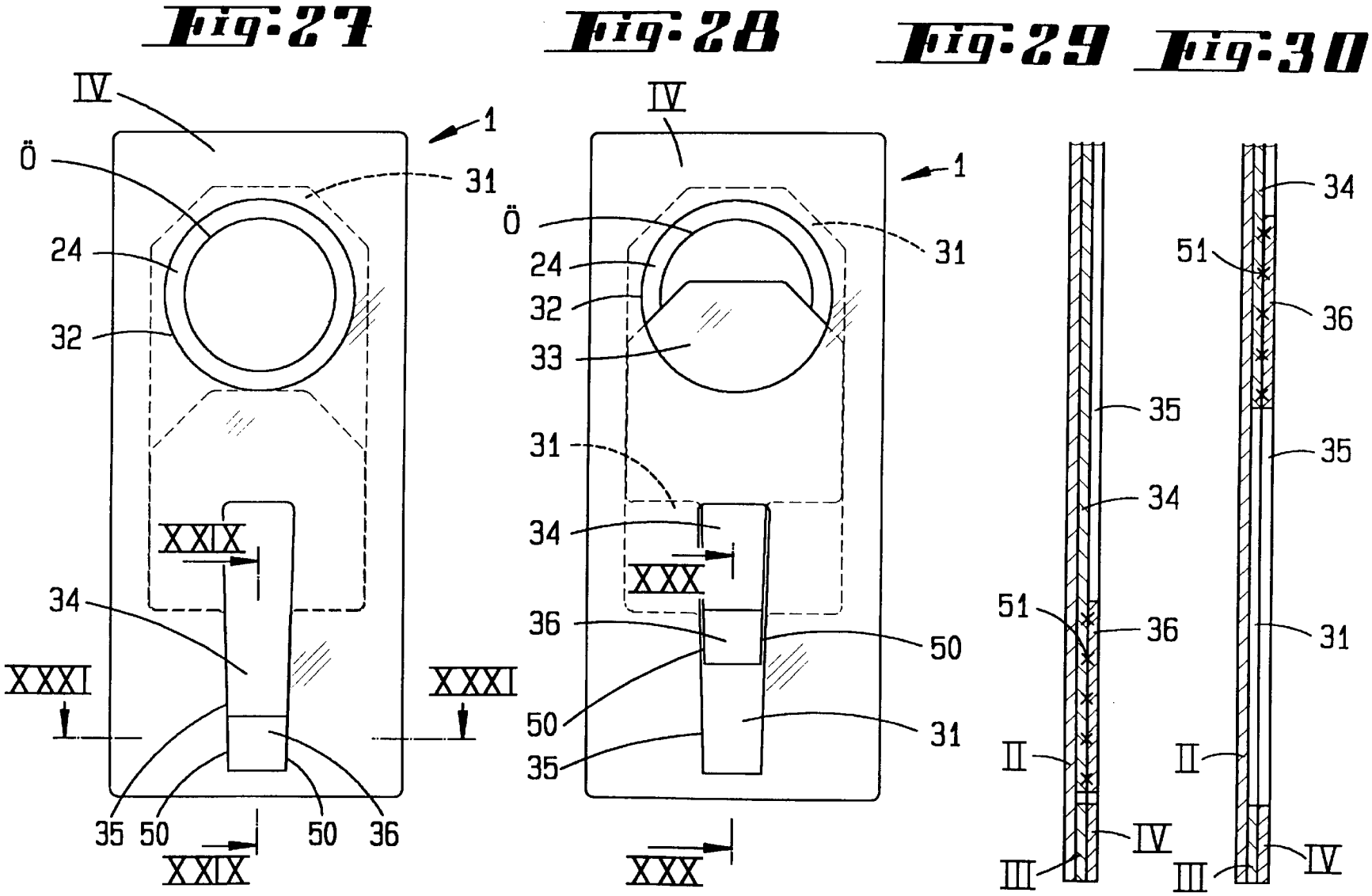
FIG. 27 is the completed retaining plate in plan view, not closed by the slide.
FIG. 28 is a like representation to FIG. 27, but partially closed by the slide.
FIG. 29 is the section according to Line XXIX—XXIX in FIG. 27.
FIG. 30 is the section according to Line XXX—XXX in FIG. 28.

The slide 30 lies, here also, within a layer III, which, as is evident from FIG. 25, forms the frame portion. The inside of the frame portion forms the above-described guide shaft 31, the slide 30 has a corresponding shape and slide stroke.

Unlike, however, the shape of the slide described in the preceding variants or embodiments, which, there, as a tongue-like component, continue practically equally widely, .the slide 30 reproduced in the last variant (FIGS. 24–32) has the form of a leaf or a paddle, inasmuch as there is adjoined to the closing end 33 of the inserted slide, as handling end 34, a narrower portion comparable to a stalk. The guiding surface portion of the faces reduces due to the substantial narrowing of the handling end 34.

The leaf stalk or the handling end 34 tapers towards the free end of the stalk.

The portion of the slide guide shaft 31 guiding the stalk or the handling end 34 also possesses a corresponding taper. This identity of outline is shown in the initial position represented in FIG. 27. In the direction of the closed position, therefore, the otherwise mutually contiguous border edges of the guiding portion and those of the handling end separate from one another and., in opposite direction, they move, in contrast, again into contiguous contact, as appears from FIG. 27. This avoids tipping over of the closing end 33, which, as for the rest, is cut to size in such a way that a well guided slide run remains guaranteed.

The corresponding conicality, however, is not confined only to the aforementioned part, but is present also in regard to the slide entraining projection 36. The latter protrudes into the window 35 of the cover plate, that is, of the layer IV. The window is realised as a recess corresponding to the stalk outline. The window extends also in the direction of the free end of the leaf stalk, continuously tapering in width. It is here also provided that the slide entraining projection 36 protruding into the window 35 corresponds, in respect of its edges lying in the direction of displacement, to the taper of the window 35. In the opening position of the slide 30, as evident from FIG. 27, the entraining projection 36 snugly fills the end region of the window there on three connected sides. On account of the taper, in the course of the closing of the opening O, the edges 50 therefore also lift off the corresponding edges of the window 35 in the sense of the aforementioned increased ease of movement of the slide 30.

The slide entraining projection 36 can be formed of a layer portion, insofar as the thickness is concerned. Such a portion is associated with the smooth side of the slide 30, likewise with the smooth side coming against it, so that the roughness 22 or rough face of this spot points outwards. This enables a non-slip grip in manual actuation of the slide 30 or, respectively, reliable gripping by a driver of a non-represented opening/closing device.

The adhesive spot holding the slide entraining projection 36 is referred to as 51. On the same side, namely the smooth side, there is located also an adhesive bead 52 encircling the frame portion close to the edge, which adhesive bead joins the layers III and IV, that is the frame portion and the cover plate.

In like manner, the base plate, namely layer II, is also provided close to the edge with such an adhesive bead 53. The latter covers, with its smooth coating 22, the roughness 23 of the back of the slide 30 and also the rough rear side of the frame portion, which is formed of the layer III.

Figure 32:
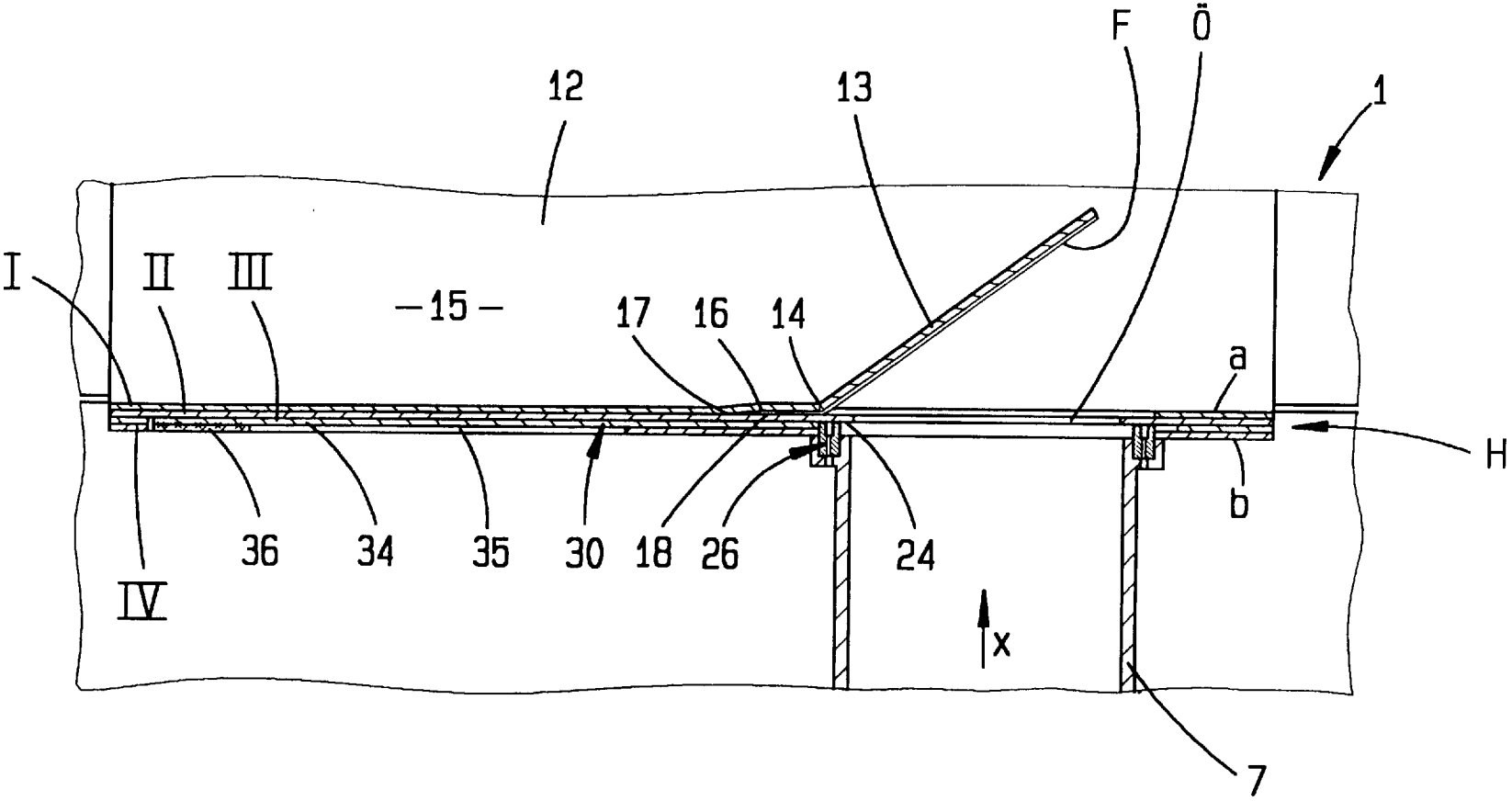
FIG. 32 is the ready-formed, assembled dust filter bag, complemented by the closure flap, in representation as in FIG. 7, that is with closure flap opened by the blowing air.

As FIG. 32 further makes clear, on the side of the retaining plate H turned towards the inside 15 of the dust bag 12, there is additionally located the layer I. Between this layer and the layer II there lies the spring element F, which biases the closure flap 13, on account of the elastic extension reserve 18, in the direction of the closed position.

We claim:

1. A dust bag for a vacuum cleaner, with a retaining plate comprising a stiff paper material to which a dust bag is joined with a closure flap turned towards the inside of the dust bag, hinged on the retaining plate, which closure flap is openable against a spring action and, in its closed condition, keeps closed an opening in the retaining plate, characterised in that a spring element formed as a layer element is arranged on the closure flap in such a way that, in a closed position, of the closure flap there is formed a clearance between a band plane and a hinge axis of the closure flap, lying outside of the band, where the hinge axis is arranged turned towards the inside of the dust bag.

2. A dust filter bag according to claim 1, characterised in that the spring element is attached to an outwards-turned first surface of the closure flap.

3. A dust filter bag according to claim 1, characterised in that the spring element continues into an edge seal of the closure flap.

4. A dust filter bag according to claim 2, wherein the spring element is formed as a layer element substantially fully overlapping the surface.

5. A dust filter bag according to claim 1, characterised in that on the retaining plate, there is provided a bearing surface adapted to the profile of the closure flap.

6. A dust filter bag according to claim 1, characterised in that the spring element is an elastic element and, in resiliently extended condition in the closed position of the closure flap, connects the latter to the retaining plate.

7. A dust filter bag according to claim 1, characterised in that the band element has a preloading corresponding to approximately 10% of the elastic extension reserve, in a closed position of the closure flap.

8. A dust filter bag according to claim 7, characterised in that the preloading is achieved by a bulge transverse to the direction of extension of the spring element.

9. A dust filter bag according to claim 1, characterised in that the spring element is held between two layers of the retaining plate.

10. A dust filter bag according to claim 1, characterised in that the spring element has a greater width than that of the region of the hinge-forming cooperation between closure flap and retaining plate.

11. A dust filter bag according to claim 5, characterised in that the stiff paper material at the bearing surface of the closure flap is treated or coated for greater smoothness.

12. A dust filter bag according to claim 5, characterised in that the bearing surface is imprinted.

13. A dust filter bag according to claim 1, characterised in that the retaining plate has on its outer side, in the region of the opening, a sealing surface for engagement of an axially aligned end face of a vacuum-cleaner blower connection piece.

14. A dust filter bag according to claim 1, further comprising a slide, and wherein the opening is additionally slidably closable by the slide.

15. A dust filter bag according to claim 14, characterised in that between the slide and the closure flap, there is formed, in the retaining plate, an intermediate plate, in which the opening is located.

16. A vacuum cleaner with a blower, a vacuum-cleaner blower connection piece and an accommodating space for the dust filter bag, where the vacuum-cleaner blower connection piece is formed for end-on engagement with a dust filter bag accommodated in the accommodating space, in particular a dust filter bag according to claim 1, characterised in that an engagement face of the blower connection piece is provided with a double ring seal.

17. A dust filter bag according to claim 16, characterised in that a chamber formed on engagement between the sealing lips of the double ring seal and the retaining plate has a passage for connection to the atmosphere.

18. A dust filter bag according to claim 17, characterised in that the passage is defined by ducts.

19. A dust filter bag according to claim 17, characterised in that the passage is defined by an unskinned portion of an open-pored foamed plastic.

20. A dust filter bag according to claim 13, further comprising a double ring seal, wherein the blower connection piece has, on the end face, an annular groove to accommodate the double ring seal, and a groove base of the groove has a break-through connecting to the outer surface.

21. A dust filter bag according to claim 1, characterised in that the retaining plate has, in the region of its hinge axis, a deflecting edge projecting over the edge of the closure flap.

22. A dust filter bag according to claim 1, wherein the retaining plate comprises a base plate, a frame portion placed on the base plate, a slide on the base plate and slideable in the frame portion which defines a guide shaft, as well as a cover plate, where, further, the cover plate has a window for reaching through to a handling end of the slide, and wherein the slide has a smoothly formed face which is smooth relative to a surface of the stiff paper material, and rests with this face on a likewise smoothly formed face of the cover plate.

23. A dust filter bag according to claim 22, wherein the base plate has a smoothly formed face which is smooth relative to a surface of the stiff paper material, and the rear side of the slide is turned towards the smoothly formed face of the base plate.

24. A dust filter bag according to claim 22, wherein the outwards-turned, face-side handling end of the slide is rough compared to its smoothly formed face and carries a slide entraining projection, which, with its rough face, points outwards.

25. A dust filter bag according to claim 22, characterised in that the slide has a leaf-shaped outline comprising a planar body with a first relatively broad portion and a second relatively narrow portion extending from the first portion.

26. A dust filter bag according to claim 25, wherein the second relatively narrow portion of the slide has the form of a leaf-stalk and serves as a handling end, the handling end tapers towards its free end carrying the slide entraining projection, and the stalk-guiding portion of a slide guide shaft corresponds to an outline of the leaf-stalk.

27. A dust filter bag according to claim 26, characterised in that the window too is formed as an aperture corresponding to the stalk outline.

28. A dust filter bag according to claim 24, characterised in that the slide entraining projection projecting into the window corresponds, in respect of its edges lying in the direction of sliding, to the taper of the window.

* * * * *